US010202711B2

(12) United States Patent
Tuteja et al.

(10) Patent No.: US 10,202,711 B2
(45) Date of Patent: Feb. 12, 2019

(54) TUNABLE SURFACE

(75) Inventors: Anish Tuteja, Cambridge, MA (US); Wonjae Choi, Cambridge, MA (US); Gareth H. McKinley, Acton, MA (US); Robert E. Cohen, Jamaica Plain, MA (US); Joseph Mark Mabry, Lancaster, MA (US)

(73) Assignee: MASSACHUSETTS INSTITUTE OF TECHNOLOGY, Cambridge, MA (US)

( * ) Notice: Subject to any disclaimer, the term of this patent is extended or adjusted under 35 U.S.C. 154(b) by 750 days.

(21) Appl. No.: 12/599,465

(22) PCT Filed: Apr. 14, 2008

(86) PCT No.: PCT/US2008/060176

§ 371 (c)(1),
(2), (4) Date: Aug. 23, 2010

(87) PCT Pub. No.: WO2009/009185

PCT Pub. Date: Jan. 15, 2009

(65) Prior Publication Data

US 2010/0316842 A1 Dec. 16, 2010

Related U.S. Application Data

(60) Provisional application No. 60/917,012, filed on May 9, 2007.

(51) Int. Cl.

| | |
|---|---|
| ***B32B 3/00*** | (2006.01) |
| ***B32B 3/30*** | (2006.01) |
| ***B32B 5/02*** | (2006.01) |
| ***B32B 9/04*** | (2006.01) |
| ***D01D 5/00*** | (2006.01) |

(Continued)

(52) U.S. Cl.

CPC ..... *D01D 5/003* (2013.01); *D01F 1/10* (2013.01); *D06M 15/263* (2013.01); *D06M 23/08* (2013.01); *D06M 2200/05* (2013.01); *Y10T 428/24355* (2015.01); *Y10T 428/24372* (2015.01); *Y10T 428/24612* (2015.01);

(Continued)

(58) Field of Classification Search

CPC ..... C09D 5/16; C09D 5/1606; C09D 5/1681; C09D 5/1612; C09D 5/1618; C09D 5/1625; C09D 5/1675; C09D 183/04; C09D 183/06; C09K 3/18; G02B 27/0006; Y10T 428/24355; Y10T 428/249921; Y10T 428/31504; Y10T 428/24372; Y10T 428/24612; Y10T 428/31663

USPC ..... 428/141

See application file for complete search history.

(56) References Cited

U.S. PATENT DOCUMENTS

2002/0164443 A1* 11/2002 Oles ..... B08B 17/02 428/35.7

2004/0067339 A1 4/2004 Gandon (Continued)

FOREIGN PATENT DOCUMENTS

WO WO 2005068399 A1 * 7/2005

OTHER PUBLICATIONS

Owen, Michael J. and Hideki Kobayashi. "Surface active fluorosilicone polymers." Macromolecular Symposia. vol. 82, Issue 1, p. 115, abstract. May 1994.*

*Primary Examiner* — Nancy R Johnson

(74) *Attorney, Agent, or Firm* — Steptoe & Johnson LLP

(57) ABSTRACT

An article can have a surface with selected wetting properties for various liquids.

7 Claims, 13 Drawing Sheets

(51) Int. Cl.
*D01F 1/10* (2006.01)
*D06M 15/263* (2006.01)
*D06M 23/08* (2006.01)

(52) U.S. Cl.
CPC ..... *Y10T 428/249921* (2015.04); *Y10T 428/31504* (2015.04); *Y10T 428/31663* (2015.04)

(56) References Cited

U.S. PATENT DOCUMENTS

| | | | | |
|---|---|---|---|---|
| 2004/0209139 | A1* | 10/2004 | Extrand | 429/32 |
| 2006/0110537 | A1 | 5/2006 | Huang | |
| 2007/0066080 | A1 | 3/2007 | Kugler | |
| 2007/0099173 | A1 | 5/2007 | Spira | |
| 2007/0224391 | A1* | 9/2007 | Krupenkin | B08B 17/06 428/141 |
| 2008/0015298 | A1* | 1/2008 | Xiong et al. | 524/432 |

* cited by examiner

TUNABLE SURFACE

CLAIM OF PRIORITY

This application claims priority to PCT application No. PCT/US2008/060176, filed Apr. 14, 2008, which claims priority to provisional U.S. Patent Application No. 60/917,012, filed May 9, 2007, titled "Tunable Surfaces," each of which is incorporated by reference in its entirety.

FEDERALLY SPONSORED RESEARCH OR DEVELOPMENT

This invention was made with government support under Grant Nos. FA9550-07-1-0272 and FA9300-06M-T015, awarded by the Air Force. The government has certain rights to this invention.

TECHNICAL FIELD

This invention relates to surfaces having tunable surface energy.

BACKGROUND

Surfaces having a nanotexture can exhibit extreme wetting properties. A nanotexture refers to surface features, such as ridges, valleys, or pores, having nanometer (i.e., typically less than 1 micrometer) dimensions. In some cases, the features can have an average or rms dimension on the nanometer scale, even though some individual features may exceed 1 micrometer in size. The nanotexture can be a 3D network of interconnected pores. Depending on the structure and chemical composition of a surface, the surface can be hydrophilic, hydrophobic, or at the extremes, superhydrophilic or superhydrophobic.

SUMMARY

An article can have a surface with selected wetting properties for various liquids. The surface can include a protruding portion configured to protrude toward a liquid and a re-entrant portion opposite the protruding portion. The re-entrant surface can have negative curvature relative to the space adjacent that portion of the surface. The protruding portion and the re-entrant portion can be surfaces of a fiber or surfaces of microstructures, for example, micronails or reverse micronails. The microstructures can include a surface texture selected to influence contact angle hysteresis.

In general, an article can include a super-oleophobic surface. The superoleophobic surface can include nanoparticles. A nanoparticle can have a diameter of less than 100 nm, less than 50 nm, less than 40 nm, less than 30 nm, less than 20 nm, or less than 10 nm. The surface of the nanoparticle can be treated with a hydrophobic material. For example, the nanoparticles can be halogenated, perhalogenated, perfluorinated, or fluorinated nanoparticles, for example, perfluorinated or fluorinated silsesquioxanes. In certain embodiments, the concentration of nanoparticles can be less than 0.1 mass fraction nanoparticles, greater than 0.1 mass fraction nanoparticles, greater than 0.15 mass fraction nanoparticles, greater than 0.2 mass fraction nanoparticles, or greater than 0.25 mass fraction nanoparticles.

In another aspect, a method of manufacturing a fabric having tunable wettability can include selecting a concentration of nanoparticles to create a super-hydrophilic, a super-hydro-phobic, a super-oleophillic, or a super-oleophobic surface, forming a fiber from a mixture including a polymer and the concentration of nanoparticle, and assembling a plurality of the fibers to form a fabric. The step of selecting a concentration of nanoparticles can include choosing the concentration to create a super-hydrophilic and super-oleophobic surface or a super-hydrophobic and super-oleophilic surface. The fiber can be formed by electrospinning.

In another aspect, a method of modifying the wetting properties of a surface includes introducing a component onto the surface having a protruding portion configured to protrude toward a liquid and a re-entrant portion opposite the protruding portion. The step of introducing the component can include depositing a fiber including a polymer and a plurality of nanoparticles on the surface or forming a plurality of microstructures on the surface. The microstructures can be micronails or can include nanoparticles.

In another aspect, a method of modifying the wetting properties of a surface comprising exposing the surface to a liquid composition including a plurality of nanoparticles.

Exposing the surface to a liquid composition can include, for example, chemical solution deposition, or dip coating. The surface can include a surface of a fabric. The method can include stretching the fabric.

The details of one or more embodiments are set forth in the accompanying drawings and the description below. Other features, objects, and advantages will be apparent from the description and drawings, and from the claims.

BRIEF DESCRIPTION OF THE DRAWINGS

FIG. 1*a* is a graph depicting the variation of advancing and receding contact angles for water on the spin coated surfaces as a function of the mass fraction of fluorodecyl polyhedral oligomeric silsesquioxanes (POSS). Corresponding AFM phase images and rms roughness' (denoted as r) of the films are also provided.

FIGS. 2*a*-2*e* are graphs depicting the advancing and receding contact angles for hexadecane, dodecane, decane and octane respectively on the electrospun surfaces, as a function of the fluorodecyl POSS concentration. It is seen that there is a clear transition from the Wenzel to the metastable Cassie state for each alkane. The surfaces in the metastable Cassie state have both advancing and receding contact angles greater than 90°, even though the spin coated surfaces have are always oleophillic for all fluorodecyl POSS concentrations.

FIG. 3*a* is a graph depicting the height of liquids required to transition irreversibly from the metastable Cassie state to the Wenzel state on the surface of a steel grid coated with fibers containing 44 wt % fluorodecyl POSS. This transition allows the liquids to flow through the electrospun mat.

FIG. 3*b* is a photograph depicting a steel grid coated with electrospun fibers containing 9.1 wt % fluorodecyl POSS used for oil/water separation. As many of the electrospun surfaces are superhydrophobic and super-oleophilic, they are ideal for oil-water separation. Here, octane is colored red using an oil soluble red dye (oil red O) while the water is colored blue using a water soluble blue dye (methylene blue). It was seen that octane can pass through the fibers easily while water beads up and stays on top of the fibers. Other experiments show that a fiber surface already wetted with octane also prevents water from passing through it.

FIG. 4*a*-4*b* is a drawing depicting a cartoon illustrating the expected liquid-air interface on the micronail surface. The protruding and re-entrant surfaces of the micronails are also shown. The surface curvature of the re-entrant surfaces allows for the Young's equation to be satisfied even for $\theta<90°$, forming a composite interface with the liquid suspended on both the micronail surface and air. This composite interface leads to high contact angles for the liquid drop on the surface even if $\theta<90°$.

FIGS. 4*c*1-4*c*2 are an set of SEM micrographs depicting two micronail surfaces having square and circular flat caps respectively.

DETAILED DESCRIPTION

Figure 1A:
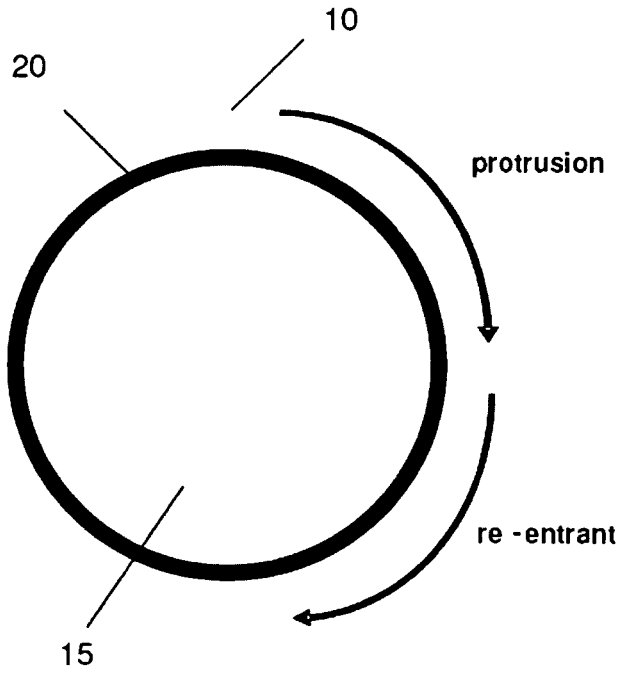
FIG. 1*aa* is a drawing depicting an object with curvature can have both a protrusion surface and a re-entrant surface.
Figure 1A:
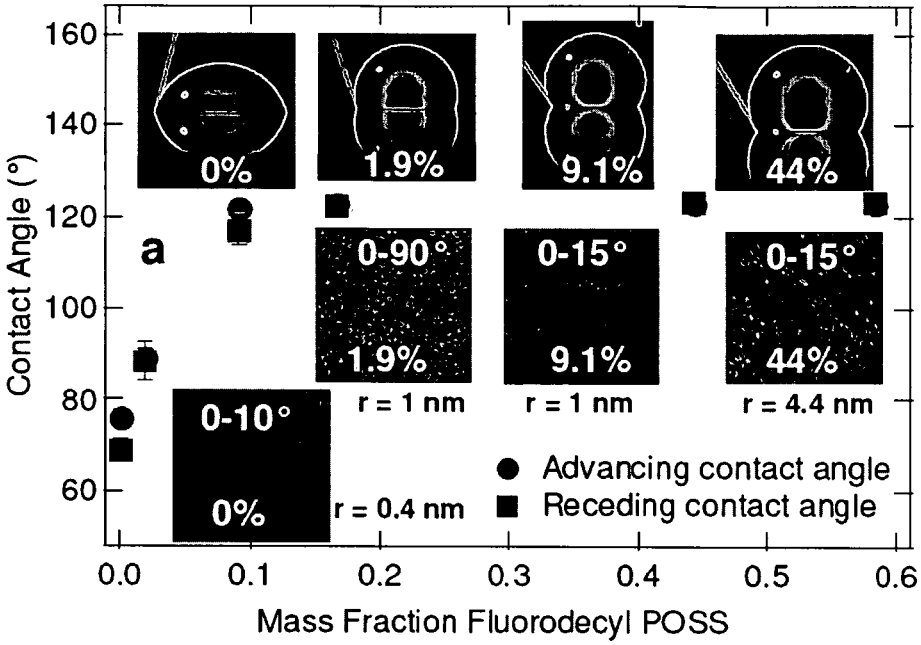

Surface geometry can create super-oleophobic surfaces. It is believed that any super-oleophobic surface has to make use of a geometry in which the surface has a protrusion portion and a re-entrant portion. Referring to FIG. 1*aa*, an article 10 can have a protrusion surface and a re-entrant surface. The article can include a core 15 and a coating 20. The core 15, the coating 20, or both, can include a plurality of nanoparticles which can further modify the properties of the surface.

In addition, fabrics with tunable wettability, produced in a single step by electrospinning two components, a polymer and a fluorinated nanoparticle. The process can be used to create super-hydrophilic, super-hydrophobic, super-oleophillic or super-oleophobic surfaces (i.e., surfaces having a contact angle >150° with alkanes such as hexadecane, decane and octane) by only changing the concentration of the nanoparticles. In general, higher the nanoparticle concentration, the lower the surface energy. This flexibility can allow surfaces having multiple desirable properties to be produced, for example, a surface that is both super-hydrophobic and super-oleophilic. Such a surface has been produced and is an excellent oil-water separator.

The produced fabrics can also be used as coatings on a wide range of rigid substrates such as metals, ceramics or bricks and glass, as well as, flexible substrates like paper and plastic. The fabric can be formed on directly the surface of the substrate or formed on a transfer medium and subsequently transferred to the surface of the substrate. The surface energy of the coating can be controlled to provide resistance or repellency to all liquids including water and alkanes or to specifically repel only a few liquids like water or alcohols.

The methods and surfaces described here can have certain advantages and improvements over other methods of surface modification. For example, super-oleophobic surfaces, i.e. surfaces which are resistant to even the lowest surface tension liquids like decane and octane, can be produced. A re-entrant surface curvature can be an essential feature for creating a super-oleophobic surface. It is likely that any super-oleophobic surface produced by any method will have to make use of this geometry.

Fabrics with tunable wettability can be produced in a single step by electrospinning. The wettability of the fabric is easily controlled by changing the concentration of the nanoparticles. This flexibility allows for the production of surfaces having multiple desirable properties, for example a surface that is both super-hydrophobic and super-oleophilic.

There are a number of different commercial applications for the various types of surfaces produced in this work. The surfaces can be a portion of any article, including a vehicle, equipment, a tool, construction material, a window, a flow reactor, a textile, or others. A few applications for each surface include the following.

Super-hydrophobic surfaces can be used to produce articles having anti-icing and/or anti-fogging properties, which can make them an ideal coating for airborne and ground-borne vehicle applications. Also, the super-hydrophobic surfaces can be self cleaning, i.e., water droplets simply roll of them, dissolving and removing any dust or debris present on the surface. Hence, they would be ideal as coating on windows, traffic lights etc. Other applications include prevention of adhesion of snow to antennas, the reduction of frictional drag on ship hulls, anti-fouling applications, stain-resistant textiles, minimization of contamination in biotechnological applications and lowering the resistance to flow in microfluidic devices.

Super-hydrophobic and super-oleophillic surfaces can be ideal for oil-water separation, which has a number of useful applications, including waste water treatment and cleaning up oil spills. Other applications include cleaning of ground water, oil well extractions, biodiesel processing, mining operations and food processing.

Super-oleophobic surfaces can be resistant to dust, debris and fingerprints. This would make them ideal as coating on lenses, computer screens, tablet computers, personal data assistants and other handheld devices. Super-oleophobic surfaces can also be used as anti-graffiti self-cleaning surfaces. Super-oleophobic surfaces can also be of great use in the petroleum industry. For example, various surfaces that are attacked by the petroleum products could be lined with these super-oleophobic coatings, preventing their degradation, for example, providing swell resistance to organic materials on fabrics. Also, super-oleophobic linings can be used as a drag reducer in various pipelines.

A number of surfaces in nature use extreme water repellency for specific purposes; be it water striding or self cleaning. A number of surfaces encountered in nature are superhydrophobic, displaying water (surface tension $\gamma$=72.1 mN/m) contact angles (WCA)>150°, and low contact angle hysteresis. The most widely-known example of a superhydrophobic surface found in nature is the surface of the lotus leaf. It is textured with small 10-20 micron sized protruding nubs which are further covered with nanometer size epicuticular wax crystalloids. See, for example, Barthlott, W. & Neinhuis, C. Purity of the sacred lotus, or escape from contamination in biological surfaces. Planta 202, 1-8 (1997). Numerous studies have shown that it is this combination of surface chemistry plus roughness on multiple scales—micron and nanoscale that imbues super hydrophobic character to the lotus leaf surface. The effects of surface chemistry and surface texture can be controlled to create high levels of oil-repellency and super-oleophobic behavior.

Two distinct models, developed by Cassie and Wenzel, are commonly used to explain the effect of roughness on the apparent contact angle of a drop sitting on a surface. See, for example, Cassie, A. B. D. & Baxter, S. Wettability of porous surfaces. Trans. Faraday Soc. 40, 546-551 (1944), and Wenzel, R. N. Resistance of solid surfaces to wetting by water. Ind. Eng. Chem. 28, 988-994 (1936). The Wenzel model recognizes that surface roughness increases the available surface area of the solid, which geometrically increases the contact angle for the surface according to:

$$\cos\theta^* = r\cos\theta \tag{1}$$

here $\theta^*$ is the apparent contact angle, r is the surface roughness, and $\theta$ is the equilibrium contact angle on a smooth surface of the same material. The Cassie model on the other hand proposes that the superhydrophobic nature of a rough surface is caused by air remaining trapped below the water droplet. This results in a composite interface with the drop sitting partially on air. Thus, the contact angle is an average between the value of the fluid-air contact angle (i.e. 180°) and $\theta$. If $\phi_s$ is the fraction of the solid in contact with water, the Cassie equation yields:

$$\cos\theta^* = -1+\phi_s(1+\cos\theta) \tag{2}$$

Thermodynamic arguments can be used to determine whether a rough hydrophobic surface will stay in the Wenzel or the Cassie state. See, for example, Marmur, A. Wetting on Hydrophobic Rough Surfaces: To Be Heterogeneous or Not To Be? Langmuir 19, 8343-8348 (2003) and Nosonovsky, M. Multiscale Roughness and Stability of Superhydrophobic Biomimetic Interfaces. Langmuir 23, 3157-3161 (2007). Previous work has shown that if a series of substrates with progressively increasing equilibrium contact angles is considered, a transition from the Wenzel to the Cassie state should ultimately be observed on the corresponding rough surfaces. See, for example, Lafuma, A. & Quere, D. Superhydrophobic states. Nat Mater 2, 457-60 (2003). The threshold value of the critical equilibrium contact angle ($\theta_c$) for this transition can be obtained by equating eqns. 1 and 2:

$$\cos\theta_c = (\phi_s - 1)(r - \phi_s) \tag{3}$$

$$\left[\text{Should equation (3) be: } \cos\theta_c = \frac{(\phi_s - 1)}{(r - \phi_s)}\,?\right]$$

Because $r>1>\phi_s$ the critical angle $\phi_c$ is necessarily greater than 90°, and thus θ>90° is required to create superhydrophobic surfaces. This is readily achievable using siloxanes or fluorinated surfaces and a wide variety of superhydrophobic surfaces have now been created. However, these arguments also explain why researchers so far have not been successful in making super-oleophobic surfaces, i.e. surfaces with contact angles >150° for mobile alkane oils such as decane (γ=23.8 mN/m) or octane (γ=21.6 mN/m). For a smooth surface to have an equilibrium contact angle >90° with a liquid alkane, the surface would need to have a surface energy <5 mN/m. See, for example, Tsujii, K., Yamamoto, T., Onda, T. & Shibuichi, S. Super oil-repellent surfaces. Angewandte Chemie-International Edition in English 36, 1011-1012 (1997). Zisman et al. reported that the surface free energy decreased in the order —$CH_2$>—$CH_3$>—$CF_2$>—$CF_2H$>—$CF_3$), and the lowest solid surface energies reported to date are in the range of ~6 mN/m (for a hexagonally closed pack arrangement of —$CF_3$ groups on a surface). See, for example, Zisman, W. A. Relation of the equilibrium contact angle to liquid and solid construction. In Contact Angle, Wettability and Adhesion, ACS Advances in Chemistry Series. (ed. Fowkes, F. M.) (American Chemical Society, Washington, D.C., 1964) and Nishino, T., Meguro, M., Nakamae, K., Matsushita, M. & Ueda, Y. The lowest surface free energy based on —$CF_3$ alignment. Langmuir 15, 4321-4323 (1999).

Surface curvature can be used as a third factor, apart from surface energy and roughness, to modify surface wettability. The surface curvature (apart from surface chemistry and roughness), can be used to significantly enhance liquid repellency, as exemplified by studying electrospun polymer fibers containing very low surface energy perfluorinated nanoparticles (FluoroPOSS). Increasing the POSS concentration in the elecrospun fibers can systematically transcend from super-hydrophilic to super-hydrophobic and to the super-oleophobic surfaces (exhibiting low hysteresis and contact angles with decane and octane greater than 150°).

A surface has a re-entrant portion surface (or negative curvature) as shown in FIG. 1*aa*, which enhances the resistance/contact angle with any liquid. The curved surface, for example, the cross section of a sphere or a fiber, always provides a point along its length such that Young's equation $$\cos\theta=(\gamma_{sv}-\gamma_{sl})/\gamma_{lv}$$

where γ refers to the interfacial tension and s, l and v refer to the solid, liquid and vapor phases, respectively, is satisfied at the air-liquid-solid interface (contact angle=equilibrium contact angle) even if θ<90°. (see, for example, Owen, M. J. & Kobayashi, H. Surface active fluorosilicone polymers. Macromol. Symp. 82, 115-123 (1994); Marmur, A. Wetting on Hydrophobic Rough Surfaces: To Be Heterogeneous or Not To Be? Langmuir 19, 8343-8348 (2003) and Nosonovsky, M. Multiscale Roughness and Stability of Superhydrophobic Biomimetic Interfaces. Langmuir 23, 3157-3161 (2007). Thus, the re-entrant surface leads to the drop sitting partially on air with high overall contact angles (Cassie state). This Cassie state is however metastable as the total energy of the system decreases significantly when the liquid advances and completely wets the surface leading to a homogeneous interface. See, for example, Nosonovsky, M. Multiscale Roughness and Stability of Superhydrophobic Biomimetic Interfaces. Langmuir 23, 3157-3161 (2007). It should be mentioned that the lower the value of θ, the more the liquid wets the curved surface, leading to higher contact angle hysteresis, even with the composite interface. Thus, a surface in the Cassie state does not necessarily have low hysteresis, as is widely believed. Surfaces without curvature or having only a protruding surface cannot lead to a composite interface if θ<90°, as the Young's equation is not satisfied at any point, other than for complete wetting.

Figure 2:
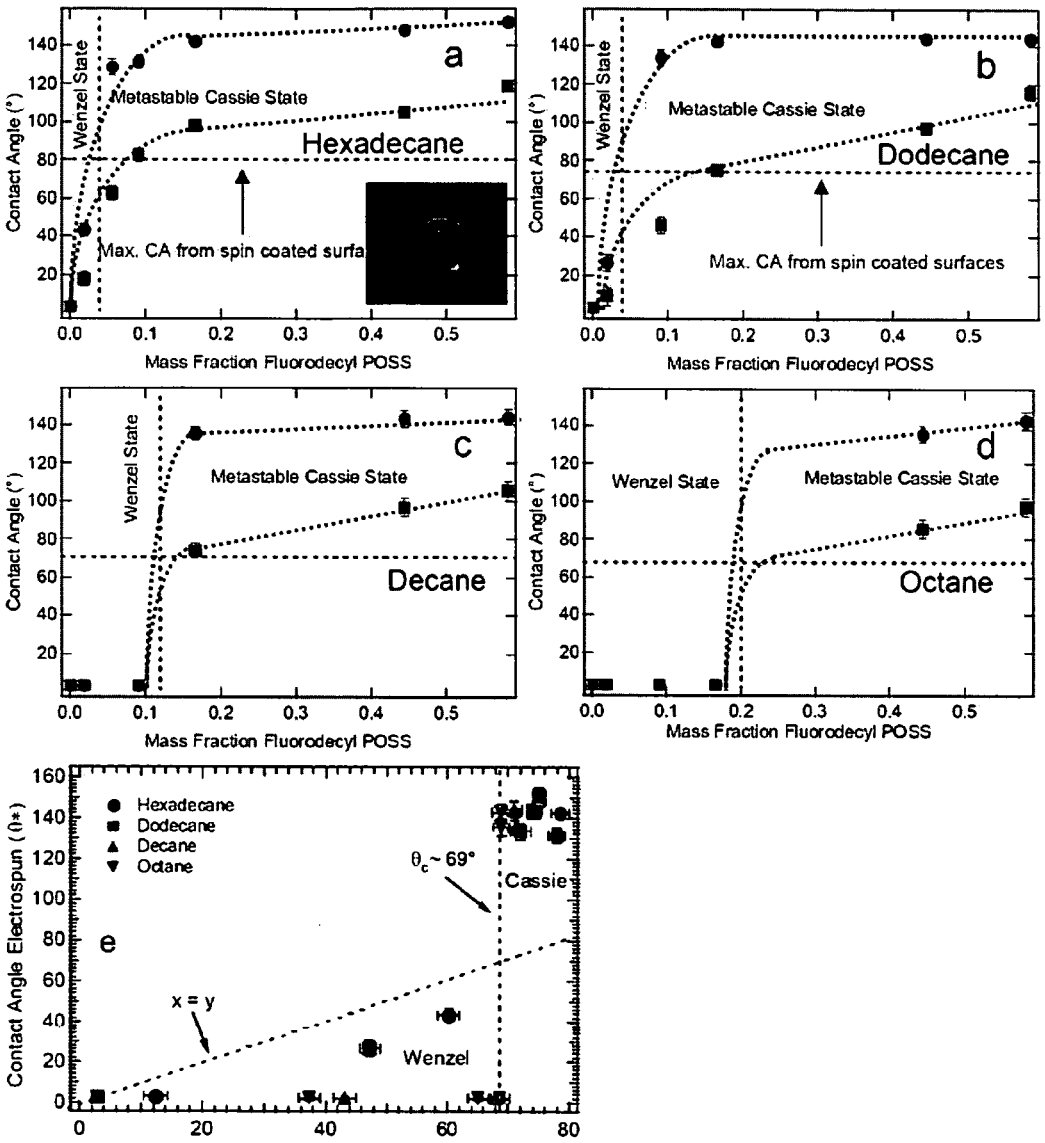
Figure 8:
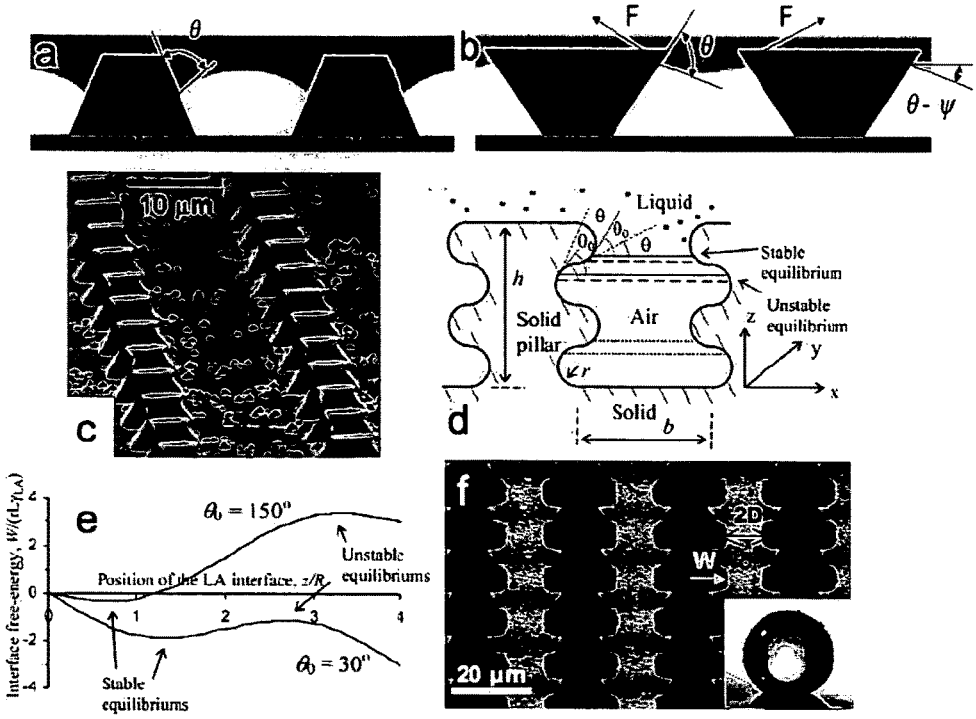
FIGS. 8*a*-8*f* are: a and b. Schematics illustrating the expected liquid-vapor interface on two idealized surfaces possessing different values of ψ. The blue surface is wetted, while the red-surface is non-wetted. c. The silicon micropost arrays developed by Cao et al. d. A schematic of a surface possessing re-entrant curvature proposed by Nosonovsky et al. e. Computed overall free energy as a function of the penetration depth (z) for two cases, one where the surface shown in FIG. 8*d* is considered to be extremely hydrophobic ($\theta=150°$) and the other when the surface is considered to be hydrophilic ($\theta=30°$). f. A scanning electron micrograph of a micro-nail surface. The inset shows a droplet of octane on the micro-nail surface.

Consider the schematics shown in FIGS. 8*a*-8*b*, which depict the expected solid-liquid-vapor profile for a liquid with θ~70° on two different surfaces. If θ<ψ, as in FIG. 2*a*, the net traction on the liquid-vapor interface is downwards, thereby facilitating the imbibition of the liquid into the solid structure, leading to a fully-wetted interface. On the other hand, if θ>ψ, as shown in FIG. 8B, the net force is directed upwards, thereby supporting the formation of a composite interface. See, for example, Cao, L.; et al. *Langmuir* 2007, 23, (8), 4310-4314, which is incorporated by reference in its entirety. In other words, either of these surfaces can support the formation of a composite interface provided θ≥ψ, (see, e.g., Tuteja, A.; et al. *Science* 2007, 318, (5856), 1618-1622; Nosonovsky, M. *Langmuir* 2007, 23, (6), 3157-3161; and Extrand, C. W. *Langmuir* 2002, 18, (21), 7991-7999; each of which is incorporated by reference in its entirety) while any liquid for which θ<ψ will immediately yield a fully-wetted interface.

The presence of re-entrant texture (or ψ<90°) in the surface illustrated in FIG. 8B allows for the formation of a composite interface and thus extremely high apparent contact angles even if θ<90°. Silicon micro-post arrays possessing re-entrant texture (See, e.g., FIGS. 4*c*1, 4*c*2, and 8B) display superhydrophobicity, even though the equilibrium contact angle for water on the silicon surface was θ=74°.

Nosonovsky analyzed the stability of composite interfaces on a range of surfaces having different roughness profiles and suggested that the creation of a stable composite interface on any rough surface requires a local minimum in the overall free energy diagram and $dA_{sl}d\theta<0$. See Nosonovsky, M. *Langmuir* 2007, 23, (6), 3157-3161, which is incorporated by reference in its entirety. Here $dA_{sl}$ is the change in solid-liquid contact area with the advancing or receding of the liquid, accompanied by a change in the local contact angle dθ. Based on this criterion, Nosonovsky proposed a liquid-repellent structure of rectangular pillars, covered with semi-circular ridges and grooves as shown in FIG. 8*d*. Because of the presence of re-entrant curvature at various local regions on this structure (where 0°<y<90°), this surface provides the possibility of obtaining a composite interface with any liquid for which q>0° (see, e.g., Tuteja, A.; et al. *Science* 2007, 318, (5856), 1618-1622, which is incorporated by reference in its entirety). FIG. 8*e* shows the computed free energy as a function of the penetration depth of the liquid-vapor interface (z), for a hydrophilic (q=30°) and a hydrophobic (q=150°) surface having the same texture as shown in FIG. 8*d*. It is possible to form a composite interface (around z~1.5) on the hydrophilic surface (leading to extremely high apparent contact angles), even though the equilibrium contact angle for this surface is only 30°. However, this composite interface configuration is not the true equilibrium state as the fully wetted interface (around z~4) leads to a lower overall free energy. However, it is clear that the correct choice of surface texture can lead to the formation of metastable (energetically trapped) composite interfaces, and extremely high contact angles, even though the solid surface by itself may be hydrophilic. See, for example, Herminghaus, S. *Europhys. Lett.* 2000, 52, (2), 165-170; Tuteja, A.; et al. *Science* 2007, 318, (5856), 1618-1622; Marmur, A. *Langmuir* 2003, 19, (20), 8343-8348; Patankar, N. A. *Langmuir* 2003, 19, (4), 1249-1253; and He, B.; Patankar, N. A.; Lee, J. *Langmuir* 2003, 19, (12), 4999-5003; each of which is incorporated by reference in its entirety. Thus, superoleophobic surfaces can be prepared even when limited to materials exhibiting q<90° with various low surface energy alkanes.

Based on the above considerations, oleophobic surfaces were prepared electrospinning polymer-nanoparticle composite fibers. The fibers posses the re-entrant surface by virtue of their curvature, and hence have enhanced resistance to wetting by liquids. The details for the materials and the process used are as follows.

Nanoparticles can include inorganic nanoparticles. One or more of the nanoparticle can be modified to have a hydrophobic surface. The nanoparticles can be halogenated, perhalogenated, perfluorinated, or fluorinated nanoparticles, for example, perfluorinated or fluorinated silsesquioxanes. The halogenated, perhalogenated, perfluorinated, or fluorinated nanoparticles can be surface modified with organic moieties having between 1 and 20 carbon atoms, in particular, $C_2$-$C_{18}$ alkyl chains, which can be substituted or unsubstituted. The nanoparticles can have an average diameter of less than 50 nm, less than 40 nm, less than 30 nm, less than 20 nm, between 1 and 10 nm, or between 1 and 5 nm, inclusive. The nanoparticles can have a surface area to volume ratio of greater than 1 $nm^{-1}$, greater than 2 $nm^{-1}$ or greater than 3 $nm^{-1}$.

A new class of hydrophobic fluorinated polyhedral oligomeric silsesquioxanes (POSS) molecules has been developed in which the rigid silsesquioxane cage is surrounded by fluoro-alkyl groups (details for the synthesis are provided as supplementary information). A number of different molecules with different organic groups (including 1H,1H,2H,2H-heptadecafluorodecyl (referred to as fluorodecyl POSS); 1H,1H,2H,2H-tridecafluorooctyl (fluorooctyl POSS) have now been synthesized, and this class of materials is denoted generically as fluoroPOSS. The fluoroPOSS molecules contain a very high surface concentration of fluorine containing groups, including —$CF_2$ and —$CF_3$ moieties. The high surface concentration and surface mobility of these groups, as well as the relatively high ratio of —$CF_3$ groups with respect to the $CF_2$ groups results in one of the most hydrophobic and lowest surface energy materials available today. See, for example, Owen, M. J. & Kobayashi, H. Surface active fluorosilicone polymers. Macromol. Symp. 82, 115-123 (1994). (A spin coated film of fluorodecyl POSS on a Si wafer has an advancing and receding contact angle of 124.5±1.2°, with an rms roughness of 3.5 nm). Blends of a moderately hydrophilic polymer, poly(methyl methacrylate) (PMMA, $M_w$=540 kDa, PDI~2.2) and fluorodecylPOSS can be used in various weight ratios to create materials with different surface properties. Other polymers can be used in place of or in combination with other polymers. By varying the mass fraction of fluoroPOSS blended with various polymers, the surface energy of the polymer-fluoroPOSS blend can be systematically changed. This ability can afford control over the equilibrium contact angle of the blends and provide a mechanism for systematically studying the transition from the Wenzel to the Cassie state on rough surfaces made from the blends.

FIG. 1*a* shows the advancing and receding contact angle values of a spin coated blend of PMMA and fluorodecyl-POSS on a Si wafer (the rms roughness of the various films is also mentioned in FIG. 1*a*; details of the preparation in the methods section). It can be seen that the addition of fluorodecyl POSS systematically changes the receding contact angle of the surfaces from 69°-123°. The inset on the figure shows the shapes of water droplets on the surfaces with varying concentration of fluorodecylPOSS as well as the AFM phase images of the surfaces. Comparing the phase images of pure PMMA and 1.9 wt % fluorodecylPOSS suggests a large amount of surface migration of the POSS particles, as can be expected from the low surface energy material. This surface migration causes significant enhancements in the contact angle of the blend at very low mass fraction of POSS.

Figure 1B:
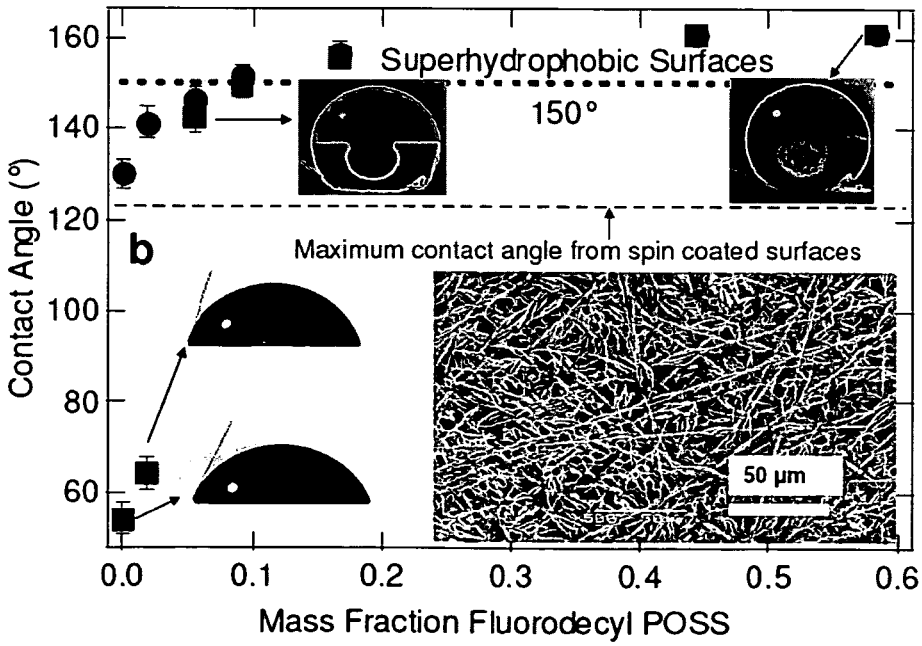
FIG. 1*b* is a graph depicting the advancing and receding contact angles for water on an electrospun surface. The legends are the same as in FIG. 1*a*. A representative SEM micrograph for the electrospun surfaces is also shown.

Smooth surfaces (maximum rms roughness of ~4.4 nm; maximum advancing water contact angle=123°) can be created by spin coating. The corresponding rough surfaces for the system can be created by electrospinning (see, for example, Ma, M. L., Hill, R. M., Lowery, J. L., Fridrikh, S. V. & Rutledge, G. C. Electrospun poly(styrene-block-dimethylsiloxane) block copolymer fibers exhibiting superhydrophobicity. Langmuir 21, 5549-5554 (2005)) solutions of fluorodecyl POSS and PMMA from Asahiklin-AK225 (Asahi Glass Co.) solvent. The density of fibers can be modified, selected or otherwise adjusted to allow fluid to contact one or more fibers at one time depending on the sag of the bottom of a drop of fluid. FIG. 1*b* shows the contact angle variation as a function of mass fraction of POSS for an electrospun mat of the same PMMA-fluorodecyl POSS blend at the same mass fractions as FIG. 1*a* (details of the electrospinning process are provided in the methods section). The inset on the figure shows a typical scanning electron m microscope (SEM) micrograph for the various systems. There is no observable change in the micron scale structure with increasing mass fraction of POSS as observed using the SEM. It is can be seen that the process of electrospinning has provided enough roughness (and porosity) to the surface to turn it superhydrophobic for all POSS concentrations above ~10 wt %. The graph also shows the maximum contact angle for the PMMA-POSS blend on a flat surface (123°). An interesting observation can be made for the advancing contact angles of the pure PMMA and 1.9 wt % POSS electrospun surfaces. It is seen that the advancing contact angles for both these cases are greater than 90°, even though the advancing contact angles on a flat surface (spin coated) are less than 90°. It is thus possible to generate very hydrophobic rough surfaces, with high advancing contact angles, even though their corresponding smooth surfaces are hydrophilic.

Figure 3:
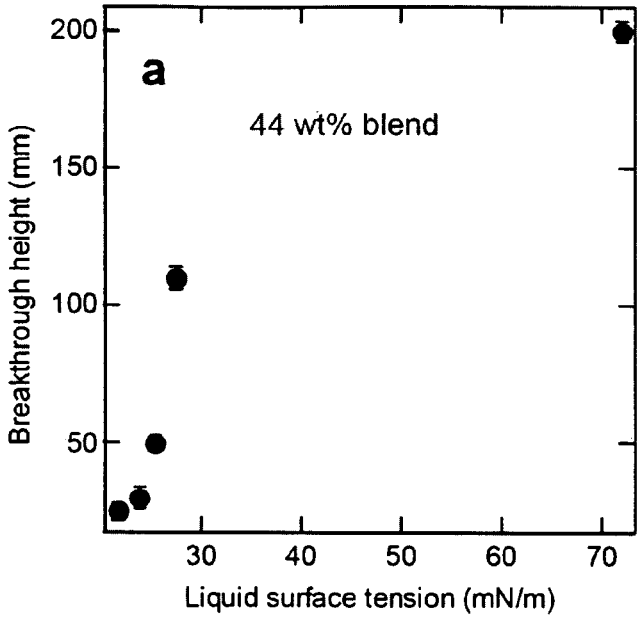
Figure 3:
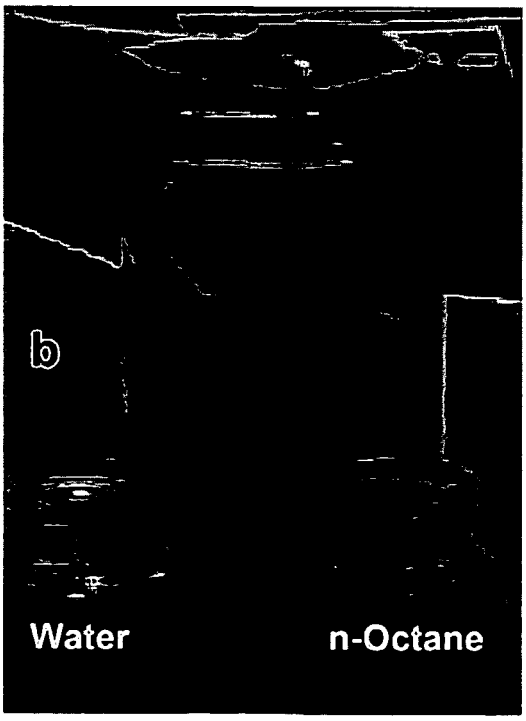
Figure 4:
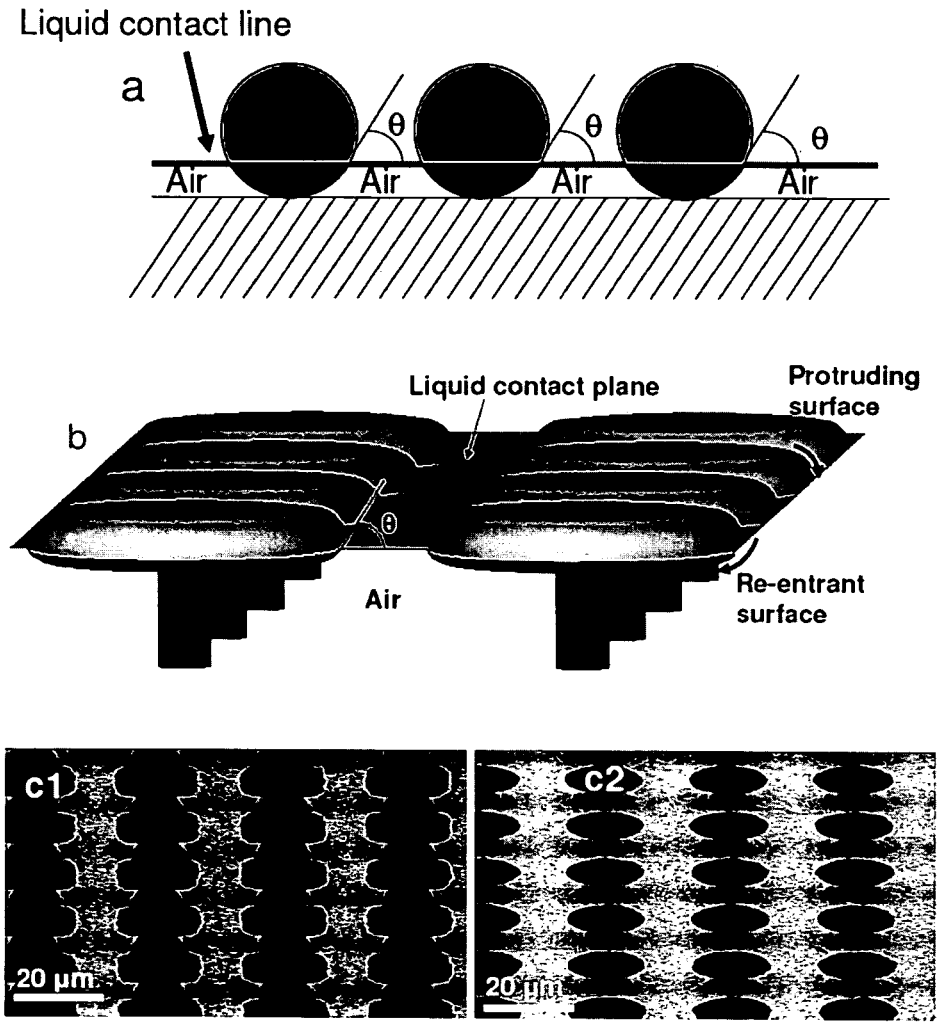

A number of different researchers have seen similar effects with unusual hydrophobicity or oleophobicity obtained from rough materials whose corresponding smooth surfaces are hydrophillic or oleophillic, and have so far been unable to explain these unexpected results (the surfaces should be in the Wenzel state leading to contact angles less than θ). See, for example, Tsujii, K., Yamamoto, T., Onda, T. & Shibuichi, S. Super oil-repellent surfaces. Angewandte Chemie-International Edition in English 36, 1011-1012 (1997), Shibuichi, S., Yamamoto, T., Onda, T. & Tsujii, K. Super water- and oil-repellent surfaces resulting from fractal structure. Journal of Colloid and Interface Science 208, 287-294 (1998), Chen, W. et al. Ultrahydrophobic and Ultralyophobic Surfaces: Some Comments and Examples. Langmuir 15, 3395-3399 (1999) and Meifang, Z., Weiwei, Z., Hao, Y., Wen, Y. & Yanmo, C. Superhydrophobic surface directly created by electrospinning based on hydrophilic material. Journal of Materials Science 41, 3793 (2006). This unusual effect is further explored in FIG. 1*c* which shows a plot of the apparent contact angle ($\theta_{apparent}$) on the rough electrospun surface as θ for the corresponding smooth (spin coated) surface is varied by changing the blend composition. It can be seen that the transition from the Cassie to the Wenzel state for these systems does not occur as the contact angle is progressively reduced to 90°. It is thus possible to generate very hydrophobic rough surfaces, with high advancing contact angles, even though their corresponding smooth surfaces are hydrophilic! However, these textured surfaces exhibit high contact angle hysteresis (the receding contact angles are much lower than θ, indicative of being in the Wenzel state). Liquid droplets deposited on the fiber surfaces are trapped in a nonwetting state, as they advance, due to the severe surface curvatures of the electrospun fibers (with diameters 100-500 nm). For low POSS concentrations (<2 wt %) the re-entrant surfaces (see FIG. 3*a*) of the fibers results in high advancing contact angles, indicative of being in the Cassie state, however, separate experiments show that this Cassie state is metastable, as water droplets dropped from a certain height can wet the surface. It can also be seen here (as in FIG. 1*b*) that the electrospun surfaces transition become truly superhydrophobic ($\theta_{apparent}$>150°) for all POSS concentrations above 10 wt %. For example, the transition energy between the Cassie and Wenzel states can increase with the concentration of POSS and the electrospun fiber mat becomes truly superhydrophobic (with advancing and receding contact angles of 161±2°) at POSS concentrations above 10 wt %. The inset in the figure shows a superhydrophobic electrospun surface submerged in water. The submerged superhydrophobic surface acts like a mirror (due to the total internal reflection of light caused by the presence of a layer of air in between the superhydrophobic surface and water) displaying a reflection of the object placed in front of it. The surface remains superhydrophobic with a stable mirror even after being submerged in water for over a week.

Figure 1C:
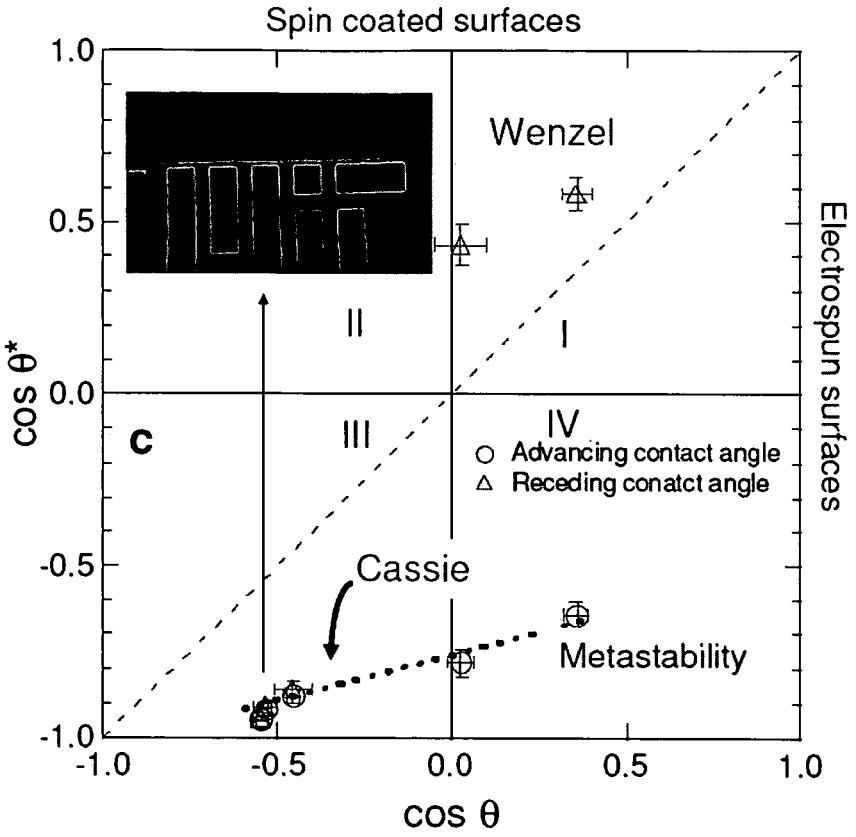
FIG. 1*c* is a graph depicting a generalized non-wetting diagram showing the contact angle of water on the electrospun surfaces as a function of its value on the spin coated surfaces. The graph has been divided 4 quadrants. Previous work has shown that the transition from the Wenzel to the Cassie state occurs in the III'rd quadrant (also because $r>1>\phi_s$). However, it is seen here that the transition from the Cassie to the Wenzel state, for the advancing drop, can be delayed well in to the IV'th quadrant as a results of the surface curvature of the electrospun surfaces.

This effect is further explored in the form of a general wetting diagram, FIGS. 1*c* and 8*a*, in which the apparent advancing and receding contact angles for water on the rough electrospun surfaces for various PMMA-fluoroPOSS blend concentrations are plotted as a function of the corresponding advancing and receding contact angles on smooth (spin-coated) surfaces. By increasing the mass fraction of the fluoroPOSS molecules blended with PMMA, it is possible to systematically lower $\gamma_{sv}$ for the polymer-fluoroPOSS blend, thereby allowing us to access this entire parameter space with a single liquid (water). It can be seen from the figure that a few data points lie in the lower right quadrant (IV) of this diagram. These surfaces correspond to hydrophilic substrates that are rendered hydrophobic, purely by re-entrant topography.

The electrospinning process is described in more detail here. PMMA was purchased from Scientific Polymer Products, Inc., while the fluorodecyl POSS nanoparticles were obtained. See, for example, Mabry, J. M.; Vij, A.; Viers, B. D.; Grabow, W. W.; Marchant, D.; Ruth, P. N.; Vij, I. "Hydrophobic Silsesquioxane Nanoparticles and Nanocomposite Surfaces," ACS Symposium Series, The Science and Technology of Silicones and Silicone-Modified Materials, Clarson, S. J.; Fitzgerald, J. J.; Owen, M. J.; Van Dyke, M. E. (Eds.), 2006. Both the polymer and the nanoparticle were dissolved in a common solvent, Asahiklin AK-225 (Asahi glass co.) in this case, at a concentration of ~5 wt %. The solution was then electrospun using a custom-built apparatus as described previously (see, for example, Shibuichi, S., Yamamoto, T., Onda, T. & Tsujii, K. Super water- and oil-repellent surfaces resulting from fractal structure. Journal of Colloid and Interface Science 208, 287-294 (1998)) with the flow rate, plate-to-plate distance and voltage set to 0.05 ml/min, 25 cm and 20 kV, respectively.

The re-entrant surfaces of the electrospun fibers can also be used to make extremely oleophobic surfaces (in the metastable Cassie state), (i.e., these electrospun surfaces are also strongly oleophobic (with advancing contact angles >140° and receding contact angles >100° for Octane)), even though all of the corresponding spin coated surfaces are oleophillic, at all POSS concentrations. FIG. 2*a*1-2*a*4 shows the advancing and receding contact angles for the electrospun surfaces for a series of alkanes (Hexadecane, Dodecane, Decane and Octane). The maximum contact angles on the spin coated surfaces for each of the alkanes is also shown. It can be seen that in many cases both the advancing and receding contact angles for the electrospun surfaces are much greater than 90°. A transition from the Wenzel to the metastable Cassie state, with increasing POSS concentration, can also be observed for each alkane. This transition systematically shifts to a higher POSS concentration (lower surface energy) with the decreasing surface tension of the liquid, suggesting that the strength of the metastability is inversely proportional to both the substrate surface energy and the liquid surface tension.

An interesting application for the electrospun materials can be derived by studying the data in FIGS. 1*b* and 2*a* and noticing that many of the electrospun surfaces are superhydrophobic and superoleophillic (alkane contact angle of ~0°). Thus, these surfaces are ideal for separating mixtures/dispersion of alkanes and water. FIG. 3*b* shows a steel wire mesh coated with fibers containing 9.1 wt % POSS, which acts as a membrane for oil-water separation. Octane droplets (colored with an oil soluble red dye) are easily able to pass through the membrane while water droplets (colored with a water soluble blue dye) bead up on the surface.

The metastability strength for the electrospun fiber surfaces is directly measured by electrospinning the PMMA+POSS fibers directly on to a steel wire mesh (with pore size of: 1 $mm^2$), and measuring the height of liquid required to 'breakthrough' the metastable Cassie surface of the fibers. This breakthrough height is shown in FIG. 3*a* for fibers containing 44 wt % POSS. It can be seen that these fibers are extremely stable and do not transition to the Wenzel state even when submerged under 110 mm of Hexadecane. Notably, apart from Octane, all of the other liquids started leaking from the edges of the container used to suspend the liquids at the heights specified in FIG. 3*a* (pressing the container edges on the surface of the fibers damages them), while the rest of the fiber surface remained oleophobic/hydrophobic. Hence, the true breakthrough heights are expected to be much greater than those mentioned here.

Herminghaus first pointed out that many leaves in nature display superhydrophobic properties, even though their flat contact angles are less than 90°, recognizing this unusual effect to be a direct result of the re-entrant surfaces (he refers to them as surfaces with overhangs, like the micronail structure described below). See, for example, Herminghaus, S. Roughness-induced non-wetting. Europhysics Letters 52, 165-170 (2000). Herminghaus also contended that the superhydrophobic state of the leaves was not the true equilibrium state (which should be the Wenzel state), and a transition from this 'metastable' state to the true equilibrium state could be made by submerging the leaf in water to a certain depth. Based on the re-entrant geometry, as well as the metastability of the re-entrant electrospun fibers, $SiO_2$ micronails i.e pillars with large flat caps (FIGS. 4*a* and 4*b*) were fabricated using lithographic chemical etching (details of the micronail synthesis are provided in the methods section). A number of different micronail surfaces with inter-nail spacing varying between 10 μm-40 μm were fabricated, in order to vary the fractional surface coverage $\phi_s$. The micronail height and cap width were held fixed at 7 and 20 μm respectively, while the cap thickness was kept at ~300 nm. SEM micrographs of two model micronail surfaces are shown in FIG. 4*c*1-4*c*2.

As an alternative to micronails, the microstructure can be a reverse micronail, in which the base is broader than the top, and the top has a re-entrant portion on the surface.

The microstructures can be spaced periodically, for example, in square or hexagonal patterns. The spacing between microstructures and height can be selected to avoid liquid contact with the substrate upon with the microstructures are built. In certain circumstances, the re-entrant portion of the surface has negative curvature relative to the space between microstructures. In an alternative method of forming the microstructures, a material can be used as a template or porophore to create microstructures on a surface of a substrate. The microstructures can be patterned in a periodic or aperiodic manner.

FIG. 4*a*-4*b* shows a representation of the liquid-air interface on the micronail surface (the thickness/width ratio for the pillar caps is exaggerated). As the distance between the nails is small in comparison to the capillary length, the effect of gravity is negligible and assuming the liquid-air interface to be a horizontal plane, as shown in the figure. The curved surface of the micronails always provides a point along its length such that the Young's equation (see, for example, Young, T. Philos. Trans. R. Soc. London 95, 65 (1805) is satisfied at the air-liquid-solid interface (see, for example, Marmur, A. Wetting on Hydrophobic Rough Surfaces: To Be Heterogeneous or Not To Be? Langmuir 19, 8343-8348 (2003) and Nosonovsky, M. Multiscale Roughness and Stability of Superhydrophobic Biomimetic Interfaces. Langmuir 23, 3157-3161 (2007)) (contact angle=equilibrium contact angle) even if $\theta<90°$. Thus, the re-entrant surface leads to the drop sitting partially on air with high overall contact angles (Cassie state). This Cassie state is however metastable as the total energy of the system decreases significantly when the liquid advances and completely wets the pillars and fills the space between them, leading to a homogeneous interface. See, for example, Nosonovsky, M. Multiscale Roughness and Stability of Superhydrophobic Biomimetic Interfaces. Langmuir 23, 3157-3161 (2007). It should be mentioned that the lower the value of θ, the more the liquid wets the pillar surface, leading to higher contact angle hysteresis, even with the composite interface. Thus, a surface in the Cassie state does not necessarily have low hysteresis, as is widely believed. Pillars without curvature or with a protruding surface cannot lead to a composite interface if $\theta<90°$, as the Young's equation is not satisfied at any point other than at the bottom of the pillars (complete wetting).

To demonstrate the importance of re-entrant curvatures in the electrospun fiber mats, model $SiO_2$ micropillars with large flat caps were also fabricated using lithographic chemical etching. A number of different pillar surfaces with inter-pillar spacing varying between 10 μm-40 μm were fabricated, in order to vary the fractional surface coverage $\phi_s$. The pillar height and cap width were held fixed at 7 and 20 μm, respectively.

Figure 5:
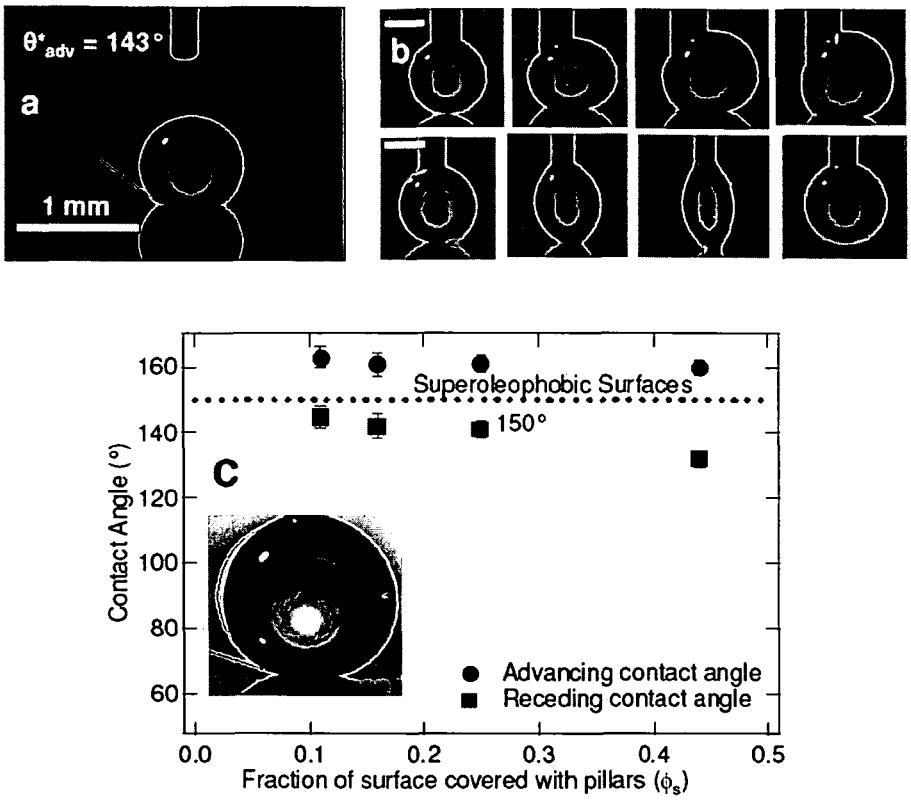
FIG. 5*a* is a photograph depicting a droplet of water on top of $SiO_2$ micronails. The inter-nail spacing for the surface is 40 μm.
FIG. 5*b* is a series of pictures taken for advancing and receding water droplets on the $SiO_2$ micronail surface. The inter-nail spacing for the surface is 10 μm.
FIG. 5*c* is a photograph depicting the advancing and receding contact angles for octane on $SiO_2$ micronails covered with a fluorosilane, as a function of $\phi_s$. These are the highest contact angles ever reported for octane on any surface.

As the $SiO_2$ nails were fabricated on flat Si wafers (covered with a layer of $SiO_2$), the contact angles can be measured for the rough (with nails) and smooth (without nails) surfaces on the same wafer. FIG. 5*a* shows that the advancing contact angle for water on the $SiO_2$ nails is ~143° (the inter-nail spacing is 40 μm and the receding contact angle on the surface is 134°), in comparison the water contact angle on the smooth $SiO_2$ surface, on the same wafer, is ~10°. The strength of the metastable Cassie state on the $SiO_2$ micronail surface is illustrated in FIG. 5*b*, which shows a series of pictures for a water droplet advancing and receding from the pillar surface (the pillars have square caps, the inter-pillar spacing is 10 μm; these pictures are taken from movies which are provided as supplementary information). It can be seen that the surface resists both the advancing and receding of the water droplet. Surfaces with higher inter-pillar spacing are not as stable.

Next, the capped $SiO_2$ pillars were treated with vapor phase tridecafluoro-1,1,2,2-tetrahydrooctyl-1-trichlorosilane, to lower the substrate surface energy chemically. FIG. 5*c* shows the advancing and receding contact angles for octane on the silanized pillar surfaces as a function of $\phi_s$ (the shape of the pillar caps, square or circular, had no effect on the contact angle and $\phi_s$ was found to be the only important parameter). The inset on FIG. 5*c* shows a drop of octane on a silanized micropillar surface (advancing contact angle ~163°, receding contact angle ~145°). These contact angles are the highest ever reported for octane on any surface. Corresponding measurements of the equilibrium contact angle for octane on a smooth $SiO_2$ surface covered with the same silane coating give θ ~55°. Additional measurements show that octane droplets on these model pillar surfaces exist in a metastable state.

It can also be seen from the figure that the receding contact angles for the surfaces decrease with increasing $\phi_s$. This is due to the additional resistance offered to the receding liquid, which is expected to be proportional to the total number of pillars on the air-liquid-solid contact line, as explained above. However, decreasing $\phi_s$ also decreases the breakthrough height (metastability strength). Thus, there is an inverse relationship between contact angle hysteresis and the stability of the composite interface which needs to be considered while designing any super-oleophobic surface.

Electrospun fiber mats can contain as little as 2 wt % POSS are strongly hydrophobic, even though spin coated surfaces with the same fluorodecylPOSS/PMMA composition remain hydrophilic. At higher concentrations of the fluoroPOSS it is also possible to create highly oleophobic substrates with low contact angle hysteresis; however these surfaces are metastable. The critical role of re-entrant surface curvature in controlling the ability to generate Cassie surface states is demonstrated by lithographically fabricating a model surface of micronails covered with a fluorosilane chemical coating. These model surfaces couple low surface energy with a re-entrant surface geometry and lead to the first truly super-oleophobic surfaces.

The combination of surface chemistry and roughness' on the micron and nanoscale imbues enhanced repellency to many natural surfaces, like the lotus leaf, when in contact with a high surface tension liquid such as water (surface tension $\delta_{lv}$=72.1 mN/m). This understanding has led to the creation of a number of biomimetic superhydrophobic surfaces (water contact angles greater than 150°, low hysteresis). However, researchers so far have been unsuccessful in producing super-oleophobic surfaces for liquids with much lower surface tensions; for example alkanes such as decane ($\gamma_{lv}$=23.8 mN/m) or octane ($\gamma_{lv}$=21.6 mN/m).

Figure 6:
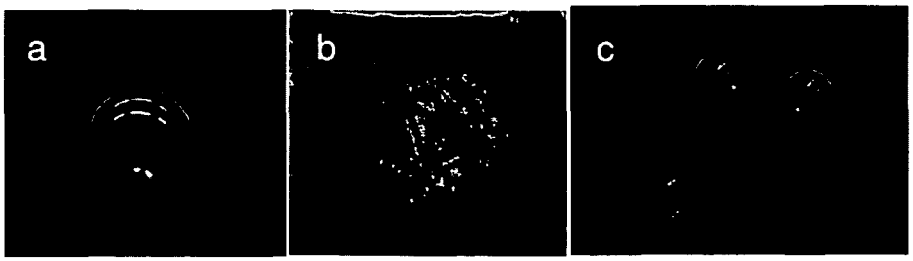
FIGS. 6*a*-*c* are a series of photographs depicting: (a) drop of water (colored with methylene blue) on a lotus leaf surface; (b) the surface of the lotus leaf after contact with a drop of hexadecane; (c) drops of hexadecane (colored with an oil soluble red dye 'oil red O') on a lotus leaf surface covered with electrospun fibers of PMMA+44 wt % fluorodecyl POSS.

FIG. 6*a* shows a drop of water (colored with methylene blue) on the surface of a lotus leaf. As expected the water droplet beads up and a very large contact angle is apparent. However, when a droplet of hexadecane wets the lotus leaf surface completely (because of its low surface tension) and a contact angle of ~0° can be observed (FIG. 6*b*).

Here, we have developed a new class of fibers which are resistant to both water and hexadecane. FIG. 6*c* shows a lotus leaf covered with these resistant fibers produced by electrospinning a solution of PMMA and fluorodecyl POSS (44 wt %) in Asahiflin AK-225 directly on top of the lotus leaf. Droplets of hexadecane (colored with a red dye 'oil red O') now bead up on this modified surface as is clearly visible. Apart from the oil resistance of the fibers, this picture also shows our ability to modify the oil repellent characteristics of surfaces with different geometries/architectures.

Figure 7:
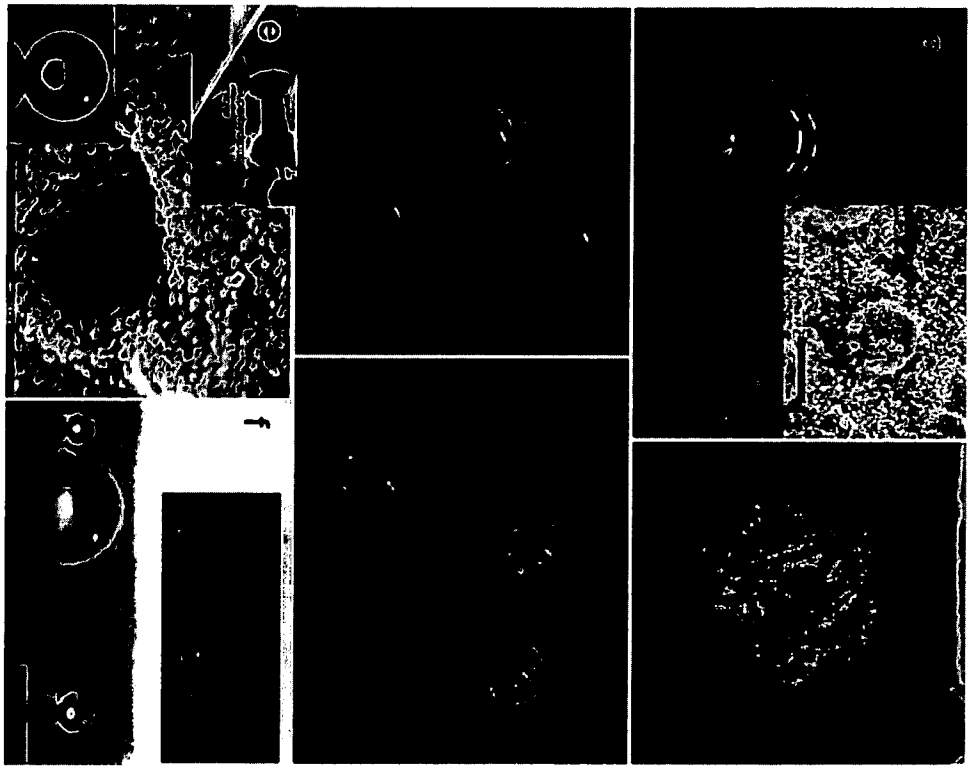
FIGS. 7*a*-7*f* are a series of photographs depicting: a. A droplet of water (colored with methylene blue) on a lotus leaf surface. The inset shows an SEM micrograph of the lotus leaf surface; the scale bar is 5 μm. b. The wetted surface of the lotus leaf after contact with a droplet of hexadecane. c and d. Droplets of water and hexadecane (colored with 'oil red O') on a lotus leaf surface covered with electrospun fibers of PMMA+44 wt % fluorodecyl POSS. e. The honeycomb-like structure of a superhydrophobic polyelectrolyte multilayer film coated with silica nanoparticles. The insets show a droplet of water sitting on the aforementioned surface and an optical image of a glass slide coated with the superhydrophobic polyelectrolyte multilayer surface submerged in a pool of water. f. An optical micrograph showing small water droplets sprayed on a superhydrophobic surface with an array of hydrophilic domains patterned using a 1% PAA water/2-propanol solution

Control of surface geometry and surface chemistry provides a highly tunable surface wetability. FIG. 7*a* is a photograph of a droplet of water (colored with methylene blue) on a lotus leaf surface. The leaf's surface is textured with small 10-20 μm protruding nubs, which are further covered with nanometer size epicuticular wax crystalloids. The inset shows an SEM micrograph of the lotus leaf surface; the scale bar is 5 μm. FIG. 7*b* shows the wetted surface of the lotus leaf after contact with a droplet of hexadecane. FIGS. 7*c* and 7*d* show droplets of water (colored with methylene blue) and hexadecane (colored with 'oil red O'), respectively, on a lotus leaf surface covered with electrospun fibers of PMMA+44 wt % fluorodecyl POSS. A reflective surface is visible underneath the droplets in both pictures, indicating the presence of microscopic pockets of air FIG. 7*e* shows the honeycomb-like structure of a superhydrophobic polyelectrolyte multilayer film coated with silica nanoparticles (see, e.g., Zhai, L.; et al. *Nano Lett.* 2004, 4, (7), 1349-1353, which is incorporated by reference in its entirety). The insets show a droplet of water sitting on the aforementioned surface and an optical image of a glass slide coated with the superhydrophobic polyelectrolyte multilayer surface submerged in a pool of water. FIG. 7*f* shows An optical micrograph showing small water droplets sprayed on a superhydrophobic surface with an array of hydrophilic domains patterned using a 1% PAA water/2-propanol solution (see Zhai, L.; et al. *Nano Lett.* 2006, 6, (6), 1213-1217, which is incorporated by reference in its entirety).

To further elucidate the significance of re-entrant curvature in the formation of a metastable composite interface, the variation in the specific Gibbs free energy caused by the propagation of the liquid-air interface on various rough surfaces was calculated. These calculations are based on the formulation described elsewhere (see, e.g., Marmur, A. *Langmuir* 2003, 19, (20), 8343-8348; and Tuteja, A.; et al. *Science* 2007, 318, (5856), 1618-1622; which is incorporated by reference in its entirety).

As an introductory example, the Gibbs free energy density variation for water (FIG. 10*a;* θ=120°) propagating on a surface covered with sinusoidal wrinkles (see inset FIG. 10*a*) was calculated. It can be seen from FIG. 10*a* that for water on the hydrophobic surface, there are two local minima in the free energy corresponding to the composite (penetration depth z~0.3) and the fully wetted interface (penetration depth z=1.0). Further, the composite interface was observed to have a much lower free energy density as compared to the fully wetted state, and was therefore the thermodynamically favored state. However, it was possible to provide enough activation energy to force the droplet to transition to the fully-wetted state. This is the idea used in the experiments of Krupenkin et al. who use electrical current and voltage to provide the activation energy required to reversibly transition between the composite and fully-wetted states on the same surface with water (see, for example, Krupenkin, T. N.; et al. *Langmuir* 2007, 23, (18), 9128-9133, which is incorporated by reference in its entirety). Other calculations on this surface with sinusoidal wrinkles show that when $\theta=\theta_c$=100°, the fully-wetted interface has a lower free energy density as compared to the composite interface and it becomes the thermodynamically favored state.

Figure 10:
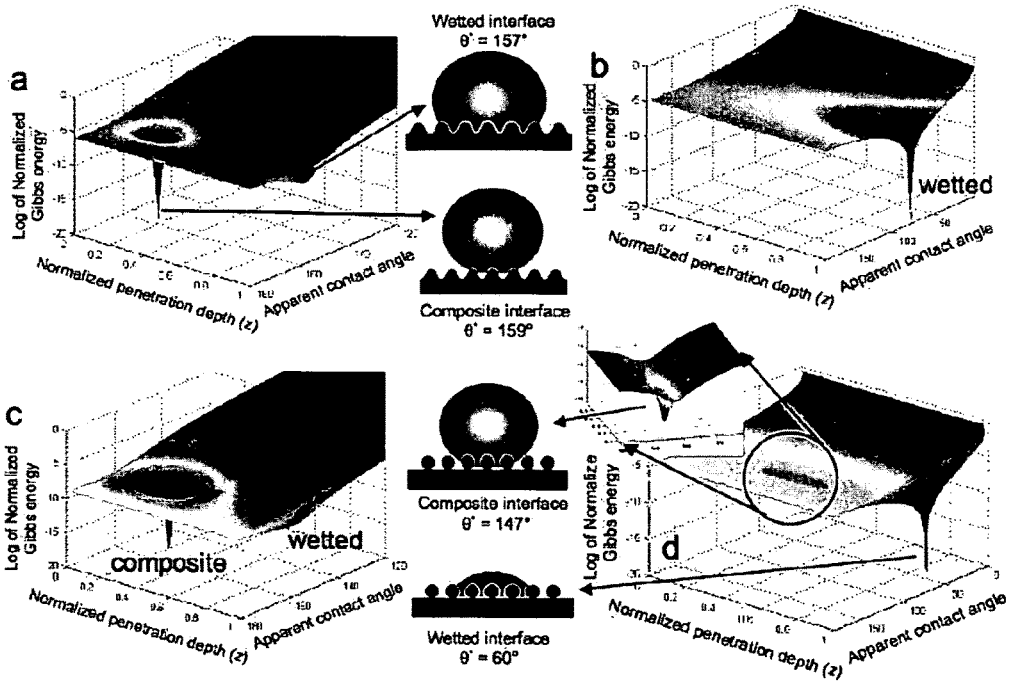
FIGS. 10*a*-10*d* are: a. A graph showing the change in the Gibbs free energy density, as a function of apparent contact angle and the penetration depth (z), for water propagating on a hydrophobic surface ($\theta=120°$) with sinusoidal wrinkles. b. A graph showing the change in the Gibbs free energy density, for hexadecane ($\theta=80°$) propagating on a surface with sinusoidal wrinkles c A graph showing the change in the Gibbs free energy density, as a function of apparent contact angle and the penetration depth (z), for water ($\theta=120°$) propagating on the electrospun PMMA+44.1 wt % fluorodecyl POSS surface. d. A graph showing the change in the Gibbs free energy density, as a function of apparent contact angle and the penetration depth (z), for hexadecane ($\theta=80°$) propagating on the electrospun PMMA+44.1 wt % fluorodecyl POSS surface. The inset on the graph shows a zoomed in view around z~0.6 to illustrate the local energy density minimization for the metastable composite interface.

FIG. 10*b* shows the calculations for Gibbs free energy density for hexadecane (θ=80°) propagating on the same sinusoidal surface shown in FIG. 10*a*. In this case we only observe a single global minimum (at z=1.0), corresponding to the fully-wetted interface with q*=60°; thus, this surface is unable to support a composite interface.

Similar calculations can be performed for the propagation of water (FIG. 10*c;* θ=120°) and hexadecane (FIG. 10*d;* θ=80°) on the electrospun fibers of PMMA and 44.1 wt % fluoroPOSS (these electrospun fibers were used to coat a lotus leaf to render it superhydrophobic and oleophobic, as shown in FIGS. 7*c* and 7*d*), shown schematically in FIG. 10*b*. For water propagating on the electrospun surface, it can be seen that the composite interface was extremely stable and was the thermodynamically favored state, as was the case on the sinusoidal surface in FIG. 10*a*. For the case of the propagation of hexadecane, in contrast to the sinusoidal surface, the presence of re-entrant curvature allows for the formation of a metastable composite interface (near the penetration depth z~0.6). It can also be seen that the overall energy of the surface can be minimized substantially if the surface transitions from the composite to the fully-wetted interface, however, there was a significant energy barrier preventing this transition. It was possible to provide the activation energy necessary to induce this transition in a variety of ways including dropping the liquid droplet from a height or applying external pressure on the drop, leading to a fully-wetted interface, as observed previously. See, for example, Herminghaus, S. *Europhys. Lett.* 2000, 52, (2), 165-170; Tuteja, A.; et al. *Science* 2007, 318, (5856), 1618-1622; and Lafuma, A.; Quere, D. *Nature Mater.* 2003, 2, (7), 457-60; each of which is incorporated by reference in its entirety.

Estimation of Solid Surface Energy ($g_{sv}$)

Previous work by Shibuichi et al. argued that for a chemically homogeneous, smooth surface to exhibit θ>90° with any liquid, its solid surface energy ($\gamma_{sv}$) must be less than one-fourth the liquid surface tension, ($\gamma_{lv}$)/4 (see, for example, K. Tsujii et al., Angew. Chem. Int. Ed. Engl. 36, 1011 (1997); and S. Shibuichi et al., J. Colloid Interface Sci. 208, 287 (1998); each of which is incorporated by reference in its entirety). Careful studies of monolayer films by Zisman et al. (W. A. Zisman, *Relation of the equilibrium contact angle to liquid and solid construction. In Contact Angle, Wettability and Adhesion, ACS Advances in Chemistry Series*. (American Chemical Society, Washington, D.C., 1964), Vol. 43, pp. 1; which is incorporated by reference in its entirety) show that the contributions to the overall magnitude of surface energy of a flat surface decreased in the order —$CH_2$>—$CH_3$>—$CF_2$>—$CF_2H$>—$CF_3$, and based on this analysis, the lowest solid surface energy is estimated to be ~6.7 mN/m (for a hexagonally closed packed monolayer of —$CF_3$ groups on a surface) (see, e.g., T. Nishino et al., Langmuir 15, 4321 (1999), which is incorporated by reference in its entirety). Taken in conjunction, these studies explain the absence of non-wetting surfaces displaying equilibrium contact angles >90° with decane and octane, as a solid surface would need to have a surface energy of ~5 mN/m to display θ>90° with these liquids (see, for example, A. Tuteja et al., Science 318, 1618 (2007); K. Tsujii et al., Angew. Chem. Int. Ed. Engl. 36, 1011 (1997); S. Shibuichi et al., J. Colloid Interface Sci. 208, 287 (1998); and W. Chen et al., Langmuir 15, 3395 (1999); each of which is incorporated by reference in its entirety).

However, recently a few groups have reported extremely low $\gamma_{sv}$ values; for example, Coulson (S. R. Coulson et al., Chem. Mater. 12, 2031 (2000); and S. R. Coulson et al., Langmuir 16, 6287 (2000); each of which is incorporated by reference in its entirety) report surface energy values as low as 1.5 mN/m for coatings created by pulsed plasma polymerization of 1H,1H,2H-perfluoro-1-dodecene.

Thus, the issue of the minimum surface energy seems to be a bit controversial and unresolved in the literature. Measurement of equilibrium contact angles only provides an indirect estimate of the surface energy, and typically involves extrapolation or assuming an additive decomposition of $\gamma_{sv}$ into dispersive and H-bonding/polar contributions. The most accurate determination of surface energies requires the measurement of the work of adhesion, and this is infrequently done (see, e.g., M. J. Owen, and H. Kobayashi, Macromol. Symp. 82, 115 (1994), which is incorporated by reference in its entirety).

Indeed, Coulson et al. also report two different measures of surface energy. They obtain values of $\gamma_v$=1.5 mN/m (on a smooth glass substrate coated by pulsed plasma polymerization of 1H,1H,2H-perfluoro-1-dodecene) and 4.3 mN/m (on a smooth glass substrate coated by pulsed plasma polymerization of 1H,1H,2H,2H-heptadecafluorodecyl acrylate) using the Zisman analysis, or $\gamma_{sv}$=8.3 mN/m and 10 mN/m using the Owens-Wendt method for the same two surfaces. See S. R. Coulson et al., Chem. Mater. 12, 2031 (2000); and S. R. Coulson et al., Langmuir 16, 6287 (2000); each of which is incorporated by reference in its entirety. It is therefore unclear as to which method provides a more accurate value for $\gamma_{sv}$. An indication that the Zisman analysis might be providing a $\gamma_{sv}$ value lower than the actual value for their surface comes from the values of octane contact angles obtained by Coulson et al. As mentioned above, if $\gamma_{sv}<\gamma_{lv}/4$, the equilibrium contact angle θ measured experimentally should be greater than 90°. In contrast, Coulson et al. report values of advancing contact angle, $\theta_{adv}$=74° and receding contact angle, $\theta_{rec}$=35° respectively on their coatings of 1H,1H,2H-perfluoro-1-dodecene when using octane ($\gamma_{lv}$=21.7 mN/m).

Figure 17:
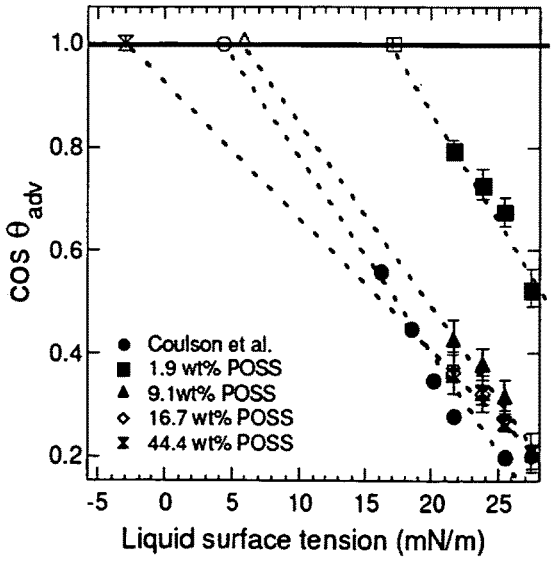
FIG. 17 is a graph depicting a Zisman plot for various spincoated PMMA+fluoroPOSS films.

We have also computed the surface energy of the various spincoated PMMA+fluoroPOSS surfaces (r.m.s roughness for all spincoated surfaces was less than 4 nm) using the Zisman and the Owens-Wendt methods. For a spincoated surface containing 44.4 wt % POSS we obtain values of $\gamma_v$=−3 mN/m and $\gamma_{sv}$=7.8 mN/m (with the dispersive component of surface energy, $\gamma_d$=6.6 mN/m and the polar component, $\gamma_p$=1.2 mN/m) using the Zisman and the Owens-Wendt method respectively. FIG. 17 shows the Zisman analysis for four different spincoated PMMA+fluoroPOSS films, as well as, the data for the Zisman analysis done by Coulson et al.

Although the negative value of the surface energy obtained from the Zisman analysis of our surfaces were spurious (and arose solely form the extrapolation process employed), however, these calculations again point out the limitations of the various methods that use measurements of equilibrium contact angles to compute $\gamma_{sv}$. It was clear from the data in FIG. 17 that, as was expected, the surface energy of the PMMA+fluoroPOSS blends decreases with increasing POSS concentration and for high fluoroPOSS concentrations, the calculated interfacial energy approached values consistent with those obtained by Coulson et al.

Designing a Robust Composite Interface.

The presence of re-entrant texture is not a sufficient condition for producing robust superhydrophobic or superoleophobic surfaces as in many cases the activation energy required to irreversibly transition from a composite interface to a fully wetted interface can be extremely small. Further, even though a Gibbs free energy approach can reliably predict the existence of a composite interface, its ability to estimate the robustness of the regime is limited as the analysis typically assumes a locally flat liquid-vapour interface. See, e.g., Tuteja, A.; et al. *Science* 2007, 318, (5856), 1618-1622; and Marmur, A. *Langmuir* 2003, 19, (20), 8343-8348; each of which is incorporated by reference in its entirety. With actual droplets, possessing significant internal pressure or under externally applied pressure, considerable sagging of the liquid-vapour interface can occur and the actual failure of the composite regime typically originates not from the activation energy required to transition between the composite and fully-wetted states, but from the sagging of the liquid-vapour interface. Hence the robustness of a composite interface can be significantly lower than the values obtained using Gibbs free energy calculations.

To provide a relative measure of the pressure required to cause the breakdown of a composite interface, we have developed the robustness parameter H* which relates to the sagging of the liquid-vapor interface as a result of pressure (Laplace pressure, external pressure or gravity). H* compares the maximum pore depth ($h_2$ in FIG. 9*b*) with the sagging depth of the interface ($h_1$ in FIG. 8*b*).

Figure 9:
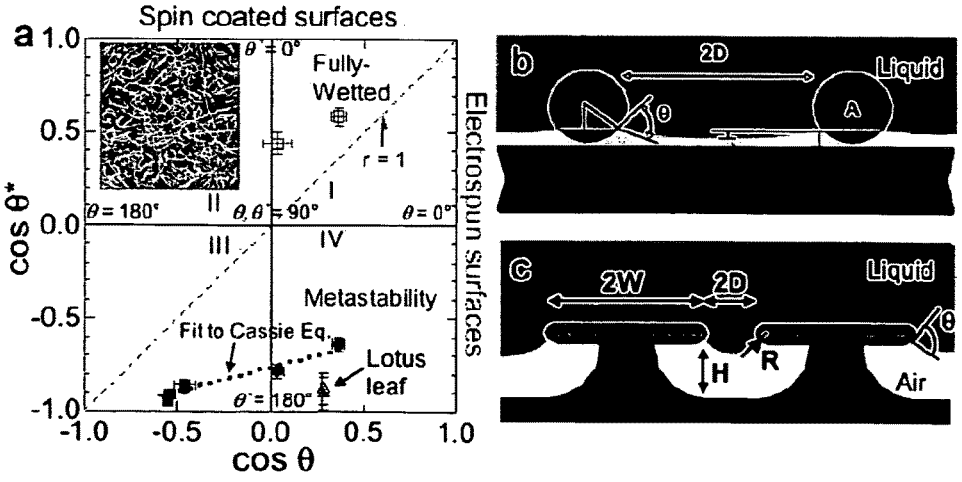
FIGS. 9*a*-9*c* are: a. A graph depicting $\cos\theta^*_{adv}$ (red circles) and $\cos\theta^*_{rec}$ (blue squares) for water as a function of $\cos\theta_{adv}$ and $\cos\theta_{rec}$. The inset shows a scanning electron microscope (SEM) micrograph for an electrospun surface composed of PMMA+9.1 wt % fluorodecyl POSS (reproduced with permission from Tuteja et al.[15]). b. A schematic of the electrospun fibers, illustrating its important surface characteristics. c. A schematic illustrating the important surface characteristics of the micro-nail surface.
Figure 15:
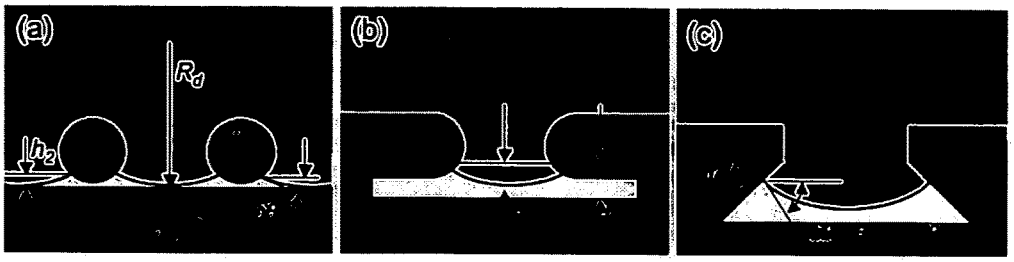
FIGS. 15*a*-15*c* are schematics illustrating the key geometrical parameters for fibers and the micro-nail surfaces.

Consider the idealized fiber mat surface shown schematically in FIGS. 9*b* and 15*a*. Such a surface would fail if the liquid-vapor interface touches the next layer of fibers and the liquid continues to wet the solid substrate. The sagging depth of the liquid-air interface ($h_1$) in this case is given as $h_1=\kappa^{-1}[1-\cos(\sin^{-1}(D\kappa))]$ where κ is the curvature of the liquid-air interface. Generally, κ=pressure/$2\gamma_{lv}$ and it becomes the inverse of the capillary length $l_{cap}=\sqrt{\gamma_{lv}/\rho g}$ for liquid droplets on a surface in the absence of any external pressure.

The system transitions from a composite interface to a fully wetted interface when the sagging height ($h_1$) becomes equal to the original clearance between the liquid-vapor interface and the next level of fibers (pore depth), $h_2=R(1-\cos\theta)$ (neglecting any shift in contact angle due to sagging). When $D=1/\kappa\approx l_{cap}$ (which is true for most micro or nano scale textures), $\sin(D\kappa)\approx D\kappa$. Thus, $h_1\approx\kappa^{-1}(1-\cos(D\kappa))\approx\kappa D^2/2$.

Therefore, the ratio, $$H^*=h_2/h_1\approx 2(1-\cos\theta)R l_{cap}/D^2 \quad (4)$$

The robustness parameter for the micro-nail geometry (FIG. 9*c*) can be similarly calculated to be: $H^*=2((1-\cos\theta)R+H)l_{cap}/D^2$ Thus, a rough structure possessing a high pore depth ($h_2$) will have an extremely high value of H*. However, even if the composite interface on a surface is expected to be extremely resistant to failure with its high pore depth, it can still readily fail due to a shift in the local contact angle as a result of the sagging liquid-vapor interface. Initially, on any rough surface (for example consider FIG. 15*c*), the liquid-vapor interface makes an angle v with the solid substrate (re-entrant region in this case). As the applied pressure increases, the liquid-vapor interface becomes more and more severely curved or distorted. This leads to an increase in the contact angle between the liquid-vapor interface and the solid substrate, until eventually the local contact angle becomes equal to the equilibrium contact angle for the liquid (as shown schematically in FIG. 15*c*). Any additional pressure will make the interface move and penetrate into the solid structure. Thus, the composite interface transitions to the fully-wetted interface when the sagging angle $\delta\theta=\theta-\psi$ (thus any liquid with $\theta<\psi$ will fail immediately). Considering a liquid drop with a radius equal to the capillary length of the liquid, as in the definition of H*, simple trigonometry shows that $$\delta\theta = \sin^{-1}\left(\frac{D}{R}\right) = \sin^{-1}\left(\frac{D}{l_{cap}}\right) \approx \frac{D}{l_{cap}}$$

by assuming $D<<l_{cap}$ (as done for the derivation of H*). Therefore, $$T^* = \frac{\theta-\psi}{\delta\theta} = \frac{\theta-\psi}{\sin^{-1}\left(\frac{D}{l_{cap}}\right)} \approx \frac{\theta-\psi}{\frac{D}{l_{cap}}} = \frac{l_{cap}(\theta-\psi)}{D}$$

Note that for both the electrospun and the micro-nail surfaces, re-entrant curvature leads to $\psi=0°$, which maximizes the value of $(\theta-\psi)$ for any liquid. Geometries with $\psi<0°$ (for example a spade geometry) can lead to even higher values of T*. Given a fixed value of $\psi$, T* can be maximized by increasing the value of the equilibrium contact angle ($\theta$), which can be accomplished by lowering the surface energy of the structure. This is the reason why various low surface energy molecules are applied as coatings on various re-entrant geometries, thereby simultaneously increasing the values of both the design parameters H* and T*.

The design parameter T* can be considered to be a robustness angle, while H* is a robustness height. A composite interface can therefore transition irreversibly to a fully-wetted interface by either of the two mechanisms discussed above, and it is expected that the robustness of any composite interface will be proportional to the minimum between the values of the two robustness parameters.

A third design parameter (D* or the spacing ratio) relates the surface texture parameters to the obtained apparent contact angles with any liquid. The apparent contact angles for a composite interface are determined by $\phi_s$, as defined through the Cassie relation. For any given equilibrium contact angle $\theta$, the fraction $\phi_s$ on the electrospun fiber surface (see FIG. 5*a*) is controlled by the variable $D^*=(R+D)/R$. Cassie and Baxter showed in their work that $\phi_s=(\pi R/(R+D))(1-\theta/180)$. Higher values of D* lower $\phi_s$ and consequently increase the apparent contact angle $\theta^*$, in accordance with the Cassie equation.

To achieve both extremely high apparent contact angles and a robust composite interface, the design parameters D*, H* and T* are preferably simultaneously minimized. In the case of the electrospun fibers, the three design parameters are inherently coupled. Increasing the spacing between nail heads (2D) leads to higher D* values, however, this also leads to lower values of both T* and H* corresponding to more severe sagging of the liquid-air interface. This, in turn, allows for easier liquid penetration through the structure. For the micro-nail geometry, on the other hand, the spacing ratio takes the new form $$D^* = 1/f_s = \left(\frac{W+D}{W}\right)^2.$$

As the nail head width (2W) and height (H) can be varied independently (see FIG. 9*c*), the spacing ratio (D*) and the robustness parameter (H*) were easily decoupled to attain both high apparent contact angles and a highly robust composite interface on the micro-nail surface, at the same time.

Figure 11:
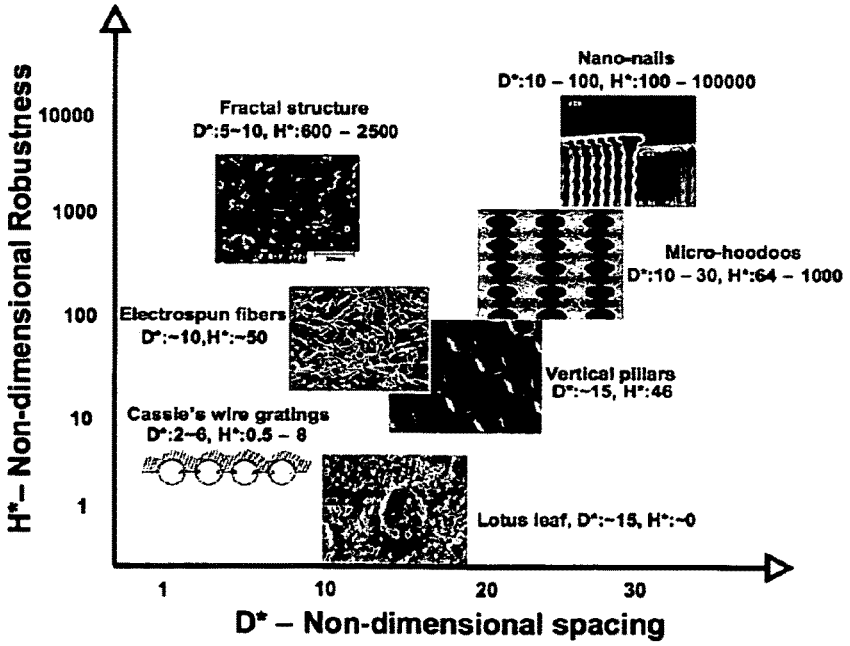
FIG. 11 is a plot of the robustness parameter (H*) as a function of the spacing ratio (D*) for octane ($\gamma_{lv}$=21.6 mN/m) on various natural and artificial surfaces discussed in the literature.

These design parameters therefore provide a mechanism for designing surfaces that are able to support super-repellency, with both high apparent contact angles and a robust composite interface. Further, they also provide a tool to rank-order various super-hydrophobic or oleophobic surfaces discussed in the literature. FIG. 11 shows a plot of the robustness parameter (H*) as a function of the spacing ratio (D*) for octane on various natural and artificial surfaces discussed in the literature. More details for each surface, including the values of the apparent contact angles with water and octane, as well as their corresponding design parameters are listed in Table I.

TABLE I

The values of the apparent contact angles ($\theta^*$) with water and octane, as well as the corresponding values for the design parameter H* for various natural and artificial surfaces discussed in the literature.

| | Water | | | Octane | | |
|---|---|---|---|---|---|---|
| Structure | $\theta^*$ | H* | $\theta-\psi$[a] | $\theta^*$ | H* | $\theta-\psi$[a] |
| Vertical pillars[39] | ~160° | ~70 | 30° | 0° | ~50 | −30° |
| Fractal structure[17 b] | ~165° | 740-3800 | 75° | 0° | 600-2500 | 0° |
| Cassie's wire gratings[30] | ~150° | 3.4-34 | 105° | N.A.[d] | 0.5-8 | 45° |
| Electrospun fiber surface[15] | ~165° | ~210 | 120° | ~140° | ~50 | 60° |
| Lotus leaf[c] | ~155° | ~180 | ~15° | 0° | ~0 | N.A.[d] |
| Micro-hoodoos[15] | ~165° | 95-1500 | 120° | 140-165° | 64-1000 | 60° |
| Nano-nails[19] | ~150° | 150-150000 | 120° | 130-150° | 100-100000 | 60° |

[a]Any liquid for which $\theta-\psi \leq 0°$ will immediately yield a fully-wetted interface.

[b]Re-entrant angle $\psi$ is hard to measure on randomly shaped textures. On these fractal-like structures, $\psi$ is expected to be ~45° as octane penetrates into the surface texture.

[c]Geometry of the lotus leaf has been estimated through the inspection of various published SEM images and is possibly prone to error.

[d]Not available.

[e]Vertical pillars, He, B.; Patankar, N. A.; Lee, J. Langmuir 2003, 19, (12), 4999-5003; Fractal structure, Tsujii, K.; et al. Angew. Chem. Int. Ed. Engl. 1997, 36, (9), 1011-1012; Cassie's wire gratings, Cassie, A. B. D.; Baxter, S. Trans. Faraday Soc. 1944, 40, 546-551; electrospun fiber surface and micro-hoodoos, Tuteja, A.; et al. Science 2007, 318, (5856), 1618-1622; nano-nails, Ahuja, A.; et al. Langmuir 2007; each of which is incorporated by reference in its entirety.

Preparation of Tunably Wettable Surfaces

Many natural and commercial surfaces such as woven and non-woven fabrics, feathers, plant leaves, spheres, cylinders etc. already have intrinsic re-entrant geometries and these surfaces can be rendered oleophobic through various simple surface treatments. These treatment are described in further detail below:

Chemical Vapor Deposition (CVD):

CVD is a chemical process used to coat a substrate with uniformly deposited high-purity, high-performance solid material. In a typical CVD process, the substrate is exposed to one or more volatile precursors, which react and/or decompose on the substrate surface to deposit the desired coating. Micro-nail structures become oleophobic after a CVD process using various fluoro-silanes as reactive, volatile precursors (see, for example, FIGS. 4*a*-4*c* and 5*a*-5*c*). CVD can produces a conformal coating on various surfaces irrespective of their geometry, and therefore is a useful coating process for re-entrant surfaces.

Chemical Solution Deposition (CSD):

CSD uses a liquid precursor, usually dissolved in an organic solvent, which reacts and thereby adheres conformably to any surface. This is a relatively inexpensive, simple process that is able to produce uniform and conformal thin coatings. Unlike CVD, which is carried out in a highly controlled environment (such as in a vacuum chamber), CSD allows for producing a coating with less rigorous/stringent environmental conditions.

Dip Coating:

Dip coating refers to the immersing of a substrate into a tank containing the coating material, removing the coated substrate from the tank, and allowing it to drain. The coated substrate can then be dried, for example, by convection or baking.

Figure 12:
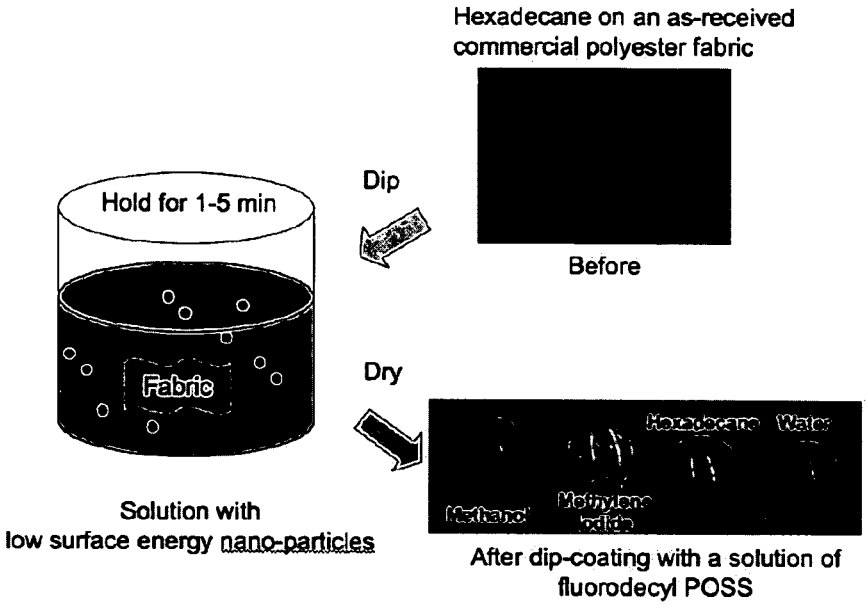
FIG. 12 is a schematic illustration of the dip-coating process.

Dip coating can be, generally, separated into three stages (see FIG. 12):

- Immersion: the substrate is immersed in the solution of the coating material at a constant speed. Preferably the immersion is judder free—in other words, the substrate is lowered into the solution in a smooth motion.
- Dwell time: the substrate remains fully immersed and motionless to allow for the coating material to apply itself to the substrate.
- Withdrawal: the substrate is withdrawn, again avoiding judders. Coating thickness can be influenced by the withdrawal speed: the faster the substrate is withdrawn from the tank, the thicker the coating.

Figure 13:
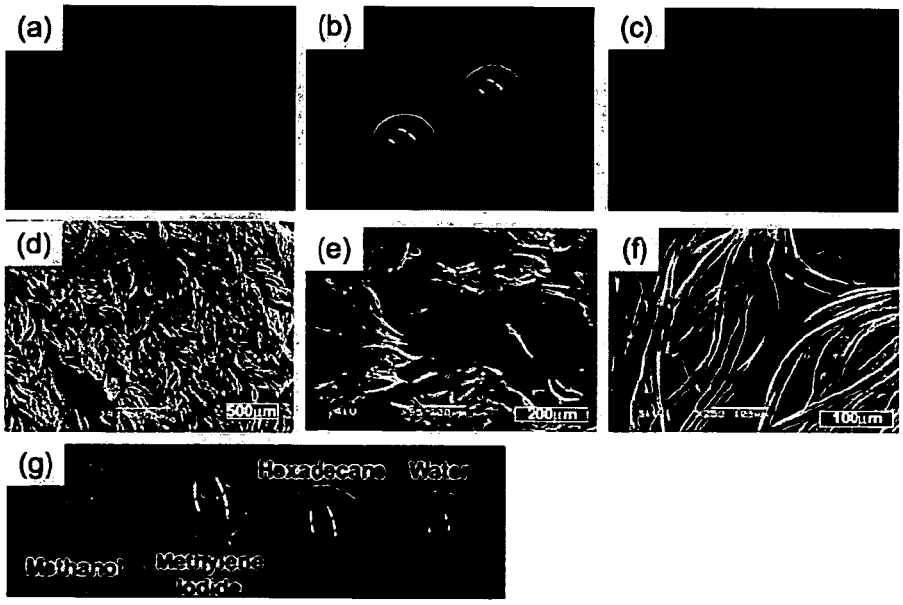
FIGS. 13*a*-13*g* are: a. A droplet of hexadecane on an uncoated duck feather. b. A droplet of hexadecane on the same feather after it was dip-coated with a solution of Tecnoflon and fluorodecyl POSS. c. A droplet of hexadecane on an uncoated, commercially available polyester fabric. d. An SEM micrograph of the uncoated polyester fabric. e. An SEM micrograph of the same polyester fabric after dip-coating with a solution of fluorodecyl POSS. f. An SEM micrograph of the same polyester fabric after dip-coating with a solution of Tecnoflon and fluorodecyl POSS. g. Droplets of water ($\gamma_{kv}$=72.1 mN/m), methylene iodide ($\gamma_{lv}$=50.8 mN/m), hexadecane ($\gamma_{lv}$=27.5 mN/m) and methanol ($\gamma_{lv}$=22.7 mN/m) on the polyester fabric's surface, after dip-coating with a solution of Tecnoflon and fluorodecyl POSS.

We have dip-coated various naturally occurring and synthetic surfaces that inherently possess re-entrant curvature, to make them superoleophobic. A few examples are shown in FIGS. 13*a*-13*g*, where both duck feathers (FIG. 13*a*, uncoated; FIG. 13*b*, coated) and a commercial polyester fabric (FIG. 13*c*) were coated with FluoroPOSS. It is seen that the coating is transparent and maintains the inherent texture of both the fabric and the feather. The feather and the fabric can also be coated with mixtures of FluoroPOSS and various commercially available polymers (like poly methylmethacrylate or Tecnoflon® from Solvay-Solexis, etc.), to obtain similar results. Dip coating with a polymer-fluoroPOSS mixture also prevents the formation of fluoroPOSS crystals on the fabric or feather surface (see FIGS. 13*e* and 13*f*), while maintaining the transparency of the coating and its performance. FIG. 13*g* shows droplets of water ($\gamma_{lv}$=72.1 mN/m), methylene iodide ($\gamma_{lv}$=50.8 mN/m), hexadecane ($\gamma_{lv}$=27.5 mN/m) and methanol ($\gamma_{lv}$=22.7 mN/m) on the polyester fabric's surface, after dip-coating with a solution of Tecnoflon and fluorodecyl POSS.

Mechanical durability of the dip-coated fabrics (obtained by dip-coating with pure fluoroPOSS and fluoroPOSS-polymer mixtures) was tested by stretching the fabric multiple times and mechanically rubbing the fabric surface by hand. All of these experiments did not damage the coating (this was confirmed by imaging the microstructure of the fabric using a scanning electron microscope) or reduce performance (as determined by measuring the contact angles with various liquids, before and after testing).

Figure 14:
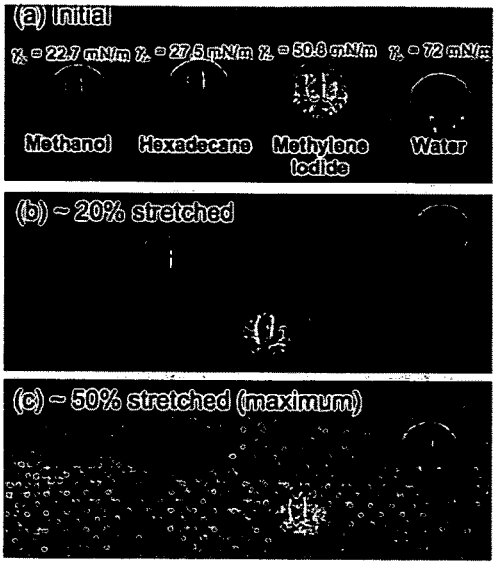
FIGS. 14*a*-14*c* are a series of photographs illustrating a polyester fabric's surface after dip-coating with a solution of Tecnoflon and fluorodecyl POSS, used for liquid-liquid separation.

One application of the dip-coated fabrics is separation of liquids having different surface tensions. Stretching of the fabric changes the pore size within the fabric (leading to a change in the value of the design parameters H* and T* for different liquids). This then allows for some liquids to wet the fabric and permeate through it, while other liquids remain unable to wet the surface. Generally, liquids with lower surface tensions begin to wet the surface first as the pore size increases. Wetting liquids are able to pass through the fabric. This is illustrated in FIG. 14, where at a particular pore size, methanol (having the lowest surface tension $\gamma_{lv}$=22.7 mN/m) is able to pass through the fabric, while the other liquids are unable to wet the fabric surface, and remain on top. Stretching the fabric further (or changing the pore size) allows for hexadecane ($\gamma_{lv}$=27.5 mN/m) to also pass through the fabric, while the other liquids still remain on the fabric surface. By changing the pore size of the fabric as well as the surface energy of the dip-coating material (as guided by the design parameters H* and T*), it is possible to separate various liquids, even though they may only have a very slight difference in surface tensions.

Controlling Contact Angle Hysteresis.

Although apparent contact angles on any surface are governed by fraction of solid in contact with a liquid ($\phi_s$), the amount of contact angle hysteresis (i.e., the difference between the advancing and receding contact angles) can vary significantly depending on the details of each individual surface texture. Hence a surface that supports a robust composite interface can also be tailored to enhance or reduce contact angle hysteresis. Low hysteresis results in very small roll off angles, corresponding to easy movement of the liquid droplets on the surface. On the other hand, high hysteresis implies that a significant amount of energy needs to be expended in moving the liquid droplet (see, e.g., Chen, W. et al. *Langmuir* 15 (10), 3395-3399 (1999), which is incorporated by reference in its entirety). This in turn can be used to adhere the liquid droplet at a particular spot on the surface.

Figure 16:
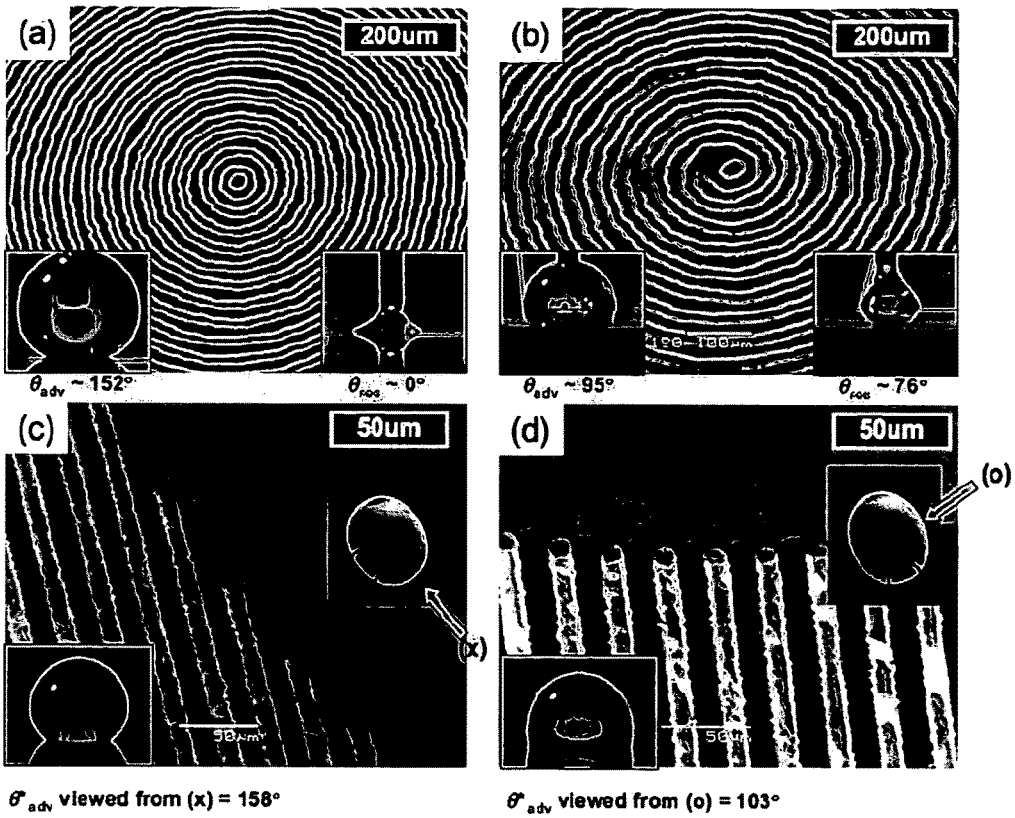
FIGS. 16*a*-16*d* are electron micrographs showing various design aimed at controlling the contact angle hysteresis.

To achieve both these aims, we have fabricated two kinds of micro-nail structures, with different surface textures, as shown in FIGS. 16*a*-16*b*. Both samples are Archimedean spirals with n=0 (FIG. 16A, results in concentric circles) or n=1 (FIG. 16B). Further, both samples are made of the same material (silicon dioxide) and have the same value of $\phi_s$ (area fraction of the solid surface). However, the local distortion of the three phase (solid-liquid-vapor) contact line during advancing and receding of any liquid is expected to be markedly different for the two samples (see, for example, Oner, D. & McCarthy, T. *Langmuir* 16 (20), 7777-7782 (2000), which is incorporated by reference in its entirety). These differences can cause a significant variation in the obtained contact angles on the two surfaces.

The texture shown in FIG. 16A was expected to exhibit maximum hysteresis, because of the marked difference in the local conditions experienced by the contact line while advancing as compared to the local conditions while receding. These variations led to $\theta^*_{adv}$~180°, while $\theta^*_{rec}$~θ, (where θ is the equilibrium contact angle, as given by the Young's equation). Due to the high hysteresis, it is very difficult for any liquid to roll or slide off the surface. In effect, any liquid on Sample A remains adhered at the spot at which it was placed initially.

The texture shown in FIG. 16B was expected to lead to minimum hysteresis, allowing for easy movement of liquid drops on the surface, because the local conditions experienced by the three phase contact line as it advances or recedes are similar. Thus, two surfaces fabricated with same material, same 0, and very similar geometry can lead to extremely different behavior of liquid droplets placed on them.

Another structure (FIG. 16C) fabricated was a striped micro-nail surface, which shows different hysteresis depending on the direction of advancing and receding, as shown in FIGS. 16*c*-16*d*.

All three designs discussed above are expected to be useful for different applications.

Concentric circles can enhance contact angle hysteresis. Such samples can be used to position and confine liquid drops at preferred locations, with the preferred shape. Surface texture-directed liquid immobilization can be useful for cell culturing, localizing liquid droplets on quartz crystal microbalances, or in chemical or biological sensors.

A spiral texture (as in FIG. 16*b*) can reduce contact angle hysteresis, allowing for easier liquid mobility while maintain superior liquid repellency. Such surfaces can be useful for most applications that require superoleophobic surfaces.

A texture of parallel lines, or stripes, leads to anisotropic hysteresis. Such surfaces can be useful in developing structures with directional wettability. These surfaces also allow for easy control over the path that any liquid follows on these surfaces, which could be very useful in controlling the movement of small volumes of liquid, for example in micro-fluidic channels.

Each reference cited herein is incorporated by reference in its entirety.

Other embodiments are within the scope of the following claims.

What is claimed is:

1. An article comprising a super-oleophobic surface, wherein the super-oleophobic surface includes nanoparticles on a surface including a plurality of structures, wherein the plurality of structures include flat caps, each of the plurality of structures including a width, a height, a protruding portion configured to protrude toward a liquid having a liquid-vapor interface between two adjacent structures and a re-entrant portion opposite the protruding portion, and a curved portion connecting the protruding portion and the re-entrant portion having a radius of curvature greater than zero, wherein the nanoparticles are fluorinated polyhedral oligomeric silsesquioxanes.

2. The article of claim 1, wherein the protruding portion and the re-entrant portion are surfaces of a microstructure.

3. The article of claim 1, wherein the microstructured surfaces include micronails.

4. The article of claim 1, wherein the surfaces of microstructures include a surface texture selected to influence contact angle hysteresis.

5. The article of claim 1, wherein the plurality of structures having periodic patterns.

6. The article of claim 1, wherein the distance between the distal end of the structures from the surface is shorter than the distance between the proximal end of the structures from the surface.

7. An article comprising a super-oleophobic surface, wherein the super-oleophobic surface includes nanoparticles on a surface including a plurality of structures, each of the plurality of structures including a width, a height, a protruding portion configured to protrude toward a liquid having a liquid-vapor interface between two adjacent structures and a re-entrant portion opposite the protruding portion, and a curved portion connecting the protruding portion and the re-entrant portion having a radius of curvature greater than zero, wherein the protruding portion and the re-entrant portion are surfaces of a micronail which include flat tops, wherein the nanoparticles are fluorinated polyhedral oligomeric silsesquioxanes.

* * * * *